US008000618B2

(12) United States Patent
Yokomizo

(10) Patent No.: US 8,000,618 B2
(45) Date of Patent: Aug. 16, 2011

(54) IMAGE FORMATION DEVICE AND IMAGE FORMATION METHOD

(75) Inventor: Tsuyoshi Yokomizo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 790 days.

(21) Appl. No.: 12/022,820

(22) Filed: Jan. 30, 2008

(65) Prior Publication Data

US 2008/0181639 A1 Jul. 31, 2008

(30) Foreign Application Priority Data

Jan. 31, 2007 (JP) ..... 2007-021420

(51) Int. Cl.
*G03G 15/20* (2006.01)

(52) U.S. Cl. ..... 399/33; 399/67

(58) Field of Classification Search ..... 399/33, 399/67, 68, 328, 330
See application file for complete search history.

(56) References Cited

U.S. PATENT DOCUMENTS

| | | | | |
|---|---|---|---|---|
| 5,768,655 | A | 6/1998 | Yoshino et al. | |
| 7,227,651 | B2 * | 6/2007 | Kamiya | 358/1.14 |
| 7,412,182 | B2 | 8/2008 | Hayashi et al. | |
| 7,817,301 | B2 * | 10/2010 | Ohno et al. | 358/1.18 |
| 2004/0156061 | A1 * | 8/2004 | Kobayashi | 358/1.12 |
| 2005/0220505 | A1 | 10/2005 | Hashimoto et al. | |
| 2006/0018676 | A1 | 1/2006 | Ishii | |

FOREIGN PATENT DOCUMENTS

| | | | |
|---|---|---|---|
| EP | 1650036 | A2 | 4/2006 |
| JP | 8083013 | A | 3/1996 |
| JP | 2000-221834 | A | 8/2000 |
| JP | 2001-047697 | A | 2/2001 |
| JP | 2002-123108 | A | 4/2002 |
| JP | 2005292651 | A | 10/2005 |
| JP | 2006-119517 | A | 5/2006 |

* cited by examiner

*Primary Examiner* — David M Gray
*Assistant Examiner* — Gregory H Curran
(74) *Attorney, Agent, or Firm* — Canon U.S.A., Inc., IP Division

(57) ABSTRACT

An image formation device, which can properly execute an image formation process even if at least any one of plural fixing units included in the image formation device cannot be used due to a breakdown or the like, is provided. In the image formation device, if a first fixing unit cannot be used, a CPU controls not to execute a first transportation process of using the first fixing unit and a second fixing unit and a second transportation process of using the first fixing unit. Further, if the second fixing unit cannot be used, the CPU controls not to execute the first transportation process but to execute the second transportation process.

22 Claims, 20 Drawing Sheets

FIG. 13

| NAME OF SHEET | BASIC WEIGHT | SURFACE PROPERTY | TRANSPORTATION PATH | 1ST FIXING UNIT | 2ND FIXING UNIT |
|---|---|---|---|---|---|
| THIN SHEET | 70g/m$^2$ | HIGH QUALITY | P2 | 180℃ | – |
| PLAIN SHEET | 90g/m$^2$ | HIGH QUALITY | P2 | 185℃ | – |
| THICK SHEET | 150g/m$^2$ | HIGH QUALITY | P1 | 180℃ | 180℃ |
| RECYCLED SHEET | 90g/m$^2$ | RECYCLED | P2 | 190℃ | – |
| HIGH-QUALITY SHEET 1 | 95g/m$^2$ | HIGH QUALITY | P2 | 190℃ | – |
| HIGH-QUALITY SHEET 2 | 93g/m$^2$ | HIGH QUALITY | P2 | 190℃ | – |
| ABC COATED 1 | 200g/m$^2$ | COATED | P1 | 180℃ | 185℃ |
| ABC COATED 2 | 210g/m$^2$ | COATED | P1 | 185℃ | 185℃ |
| ABC COATED 3 | 250g/m$^2$ | COATED | P1 | 190℃ | 190℃ |

IMAGE FORMATION DEVICE AND IMAGE FORMATION METHOD

BACKGROUND OF THE INVENTION

1. Field of the Invention

The present invention relates to an image formation device and an image formation method.

2. Description of the Related Art

Conventionally, an image formation device which forms an image by generating and fixing a toner image on a sheet has been known. More specifically, the image formation device includes a fixing unit which executes a fixing process for fixing the toner image on the sheet by heating and pressing the generated toner image. Here, it should be noted that the fixing unit generally consists of a pair of rollers, whereby the sheet which passes the pair of rollers is heated by a heater provided inside or outside at least one of rollers constituting the relevant pair. Incidentally, in the fixing unit, a temperature which is necessary to execute the fixing process is maintained by the heater which executes heating to supply an amount of heat absorbed by the sheet passing the pair of rollers.

Incidentally, the image formation device is required to execute the fixing process in regard to various different kinds of sheets whose sheet attributes such as a material, a thickness and the like vary from one kind of sheet to another. Moreover, even in case of executing the fixing process to the various kinds of sheets, the image formation device is required to execute an image formation process, including the fixing process, at constant sheet transportation speed.

However, in the case where the image formation device executes the fixing process in regard to the sheets at the constant sheet transportation speed, the amount of heat to be applied from the pair of rollers to the sheets is constant. For this reason, it is difficult to make fixability of the toner images, which have been respectively formed on various kinds of sheets of which the thickness and material are different from others, the same.

Consequently, a method of providing plural fixing units has been proposed (e.g., Japanese Patent Application Laid-Open No. 2005-292651). In this method, the number of sheets on which images are respectively formed per unit of time can be made constant and also degradation of fixability of the formed images on the respective sheets can be prevented, irrespective of kinds of sheets.

An image formation device disclosed in Japanese Patent Application Laid-Open No. 2005-292651 includes, as sheet transportation paths, a main transportation path through which the sheet passes plural fixing units and a roundabout transportation path through which the sheet passes only one fixing unit. More specifically, in the relevant image formation device, since the main transportation path and the roundabout transportation path are provided, the number of sheets on which the images are respectively formed per unit of time can be made constant and also the degradation of the fixability of the formed images on the respective sheets can be prevented, irrespective of the kinds of sheets.

However, in Japanese Patent Application Laid-Open No. 2005-292651, if at least one of the plural fixing units cannot be used due to a breakdown or the like, there is no way to cope with such a case.

In any case, if any one of the plural fixing units cannot be used due to the breakdown or the like, it is undesirable to completely stop an image formation process including a fixing process. That is, it is desirable to execute the image formation process as much as possible so as to increase the number of sheets on which images are respectively formed per unit of time.

SUMMARY OF THE INVENTION

It is desirable to address one or more of the problems set out above. It is also desirable to provide an improved image formation device and an improved image formation method.

It is also desirable to provide an image formation device and an image formation method, which can appropriately execute, in a case where plural fixing units cannot be used due to breakdown or the like, an image formation process according to such a condition that the fixing units cannot be used.

A first aspect of the present invention can provide an image formation device. The image formation device comprises a fixing device having first and second fixing units. Each fixing unit is operable to apply a fixing process to a sheet. The first and second fixing units are so arranged that, if the second fixing unit is not usable, the fixing device can apply the fixing process to a sheet using the first fixing unit. The image formation device further comprises a control unit that detects when the image formation device is in a predetermined state in which the first fixing unit is usable but the second fixing unit is not usable. The control unit causes the fixing means to apply the fixing process to at least one sheet using the first fixing unit whilst the image formation device is in the predetermined state. A second aspect of the present invention can provide an image formation method for use in an image formation apparatus comprising a fixing device having first and second fixing units. Each fixing unit is operable to apply a fixing process to a sheet. The first and second fixing units are so arranged that, if the second fixing unit is not usable, the fixing device can apply the fixing process to a sheet using the first fixing unit. The method comprises detecting when the image formation device is in a predetermined state in which the first fixing unit is usable but the second fixing unit is not usable. The method also comprises causing the fixing device to apply the fixing process to at least one sheet using the first fixing unit whilst the image formation device is in the predetermined state. A third aspect of the present invention can provide a machine-readable recording medium storing a program. The program is adapted to be executed by a computer or processor in an image formation device comprising a fixing device having first and second fixing units. Each fixing unit is operable to apply a fixing process to a sheet. The first and second fixing units are so arranged that, if the second fixing unit is not usable, the fixing device can apply the fixing process to a sheet using the first fixing unit. When the program is executed it causes the image formation device to detect when the image formation device is in a predetermined state in which the first fixing unit is usable but the second fixing unit is not usable. The program also causes the fixing device to apply the fixing process to at least one sheet using the first fixing unit whilst the image formation device is in the predetermined state.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate plural embodiments, features and aspects of the present invention and, together with the description, serve to explain the principles of the present invention.

FIG. 13 is a diagram illustrating information relevant to attributes of sheets (papers) to be used by the printing device 100 in a printing process.

DESCRIPTION OF THE EMBODIMENTS

Figure 1:
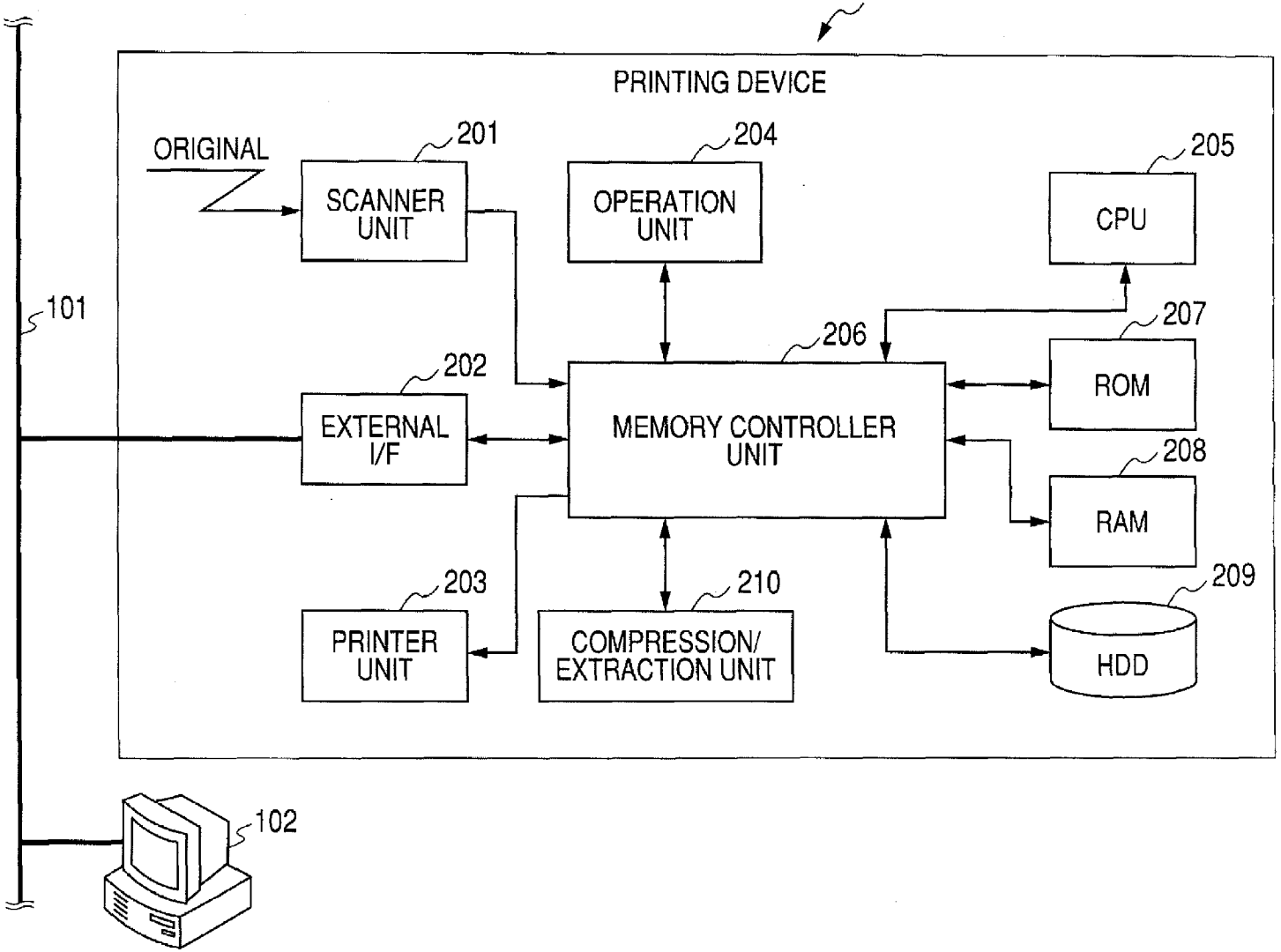
FIG. 1 is a block diagram illustrating a control constitution of a printing device 100.

The present invention will now be described in detail with reference to the attached drawings showing various embodiments thereof. In the drawings, elements and parts which are identical throughout the views are designated by identical reference numerals, and duplicate description thereof will be omitted.

Hereinafter, exemplary embodiments of the present invention will be described with reference to the attached drawings.

First Embodiment

FIG. 1 is a block diagram illustrating a control constitution of a printing device 100 according to the first embodiment of the present invention.

In FIG. 1, a scanner unit 201 optically reads plural originals (that is, plural sheets or papers on which images have been printed respectively) to generate image data, and executes an image process (for example, a shading correction process) to the read image data. Incidentally, it is assumed that the scanner unit 201 in the first embodiment can read the original as color image data. More specifically, it is assumed that the scanner unit 201 can read the original as R (red), G (green) and B (blue) three color image data. A later-described CPU (central processing unit) 205 converts the R, G and B three color image data read by the scanner unit 201 into C (cyan), M (magenta), Y (yellow) and K (black) four color image data, whereby a color image can be printed by using a printer unit 203. Then, the scanner unit 201 stores the image data, which correspond to plural pages to which an image formation process has been executed, in an HDD (hard disk drive) 209 as one print job (that is, an image formation job).

An external I/F (interface) 202 receives the print job including the image data corresponding to the plural pages, from a computer terminal 102 which is connected to the printing device 100 through a network 101 and acts as an external device. Then, the external I/F 202 stores the print job, which was received from the external device, in the HDD 209. Then, the printer unit 203 executes the printing process (that is, the image formation process) to plural sheets S (not illustrated in FIG. 1) based on the print job stored in the HDD 209. Incidentally, since the print job includes the image data corresponding to the plural pages, the plural image data are respectively print-processed in regard to the respective sheets. An operation unit 204, which accepted various instructions from an operator of the printing device 100, executes various settings to the printing device 100 by transferring the accepted instructions to a memory controller unit 206.

The CPU 205 controls the whole of the printing device 100 by writing programs read from a ROM (read only memory) 207 into a RAM (random access memory) 208 and then executing the programs through the use of the RAM 208. Incidentally, the ROM 207 stores therein a program which is used to interpret PDL (page description language) code data received as the print job from the external device through the external I/F 202. Further, the ROM 207 stores therein a program which is used to generate various data printable by the printer unit 203 after interpreting the PDL code data. Furthermore, the memory controller unit 206 controls accesses from various portions to the ROM 207, the RAM 208 and the HDD 209. ROM 207 also stores programs which, when executed by the CPU 205, cause the CPU 205 to execute the process flows shown in FIGS. 12, 15, 16 and 18 described below.

A compression/extraction unit 210 can execute a compression process to the image data stored in the RAM 208 and the HDD 209, according to various compression methods such as a JBIG (Joint Bi-level Image experts Group) method, a JPEG (Joint Photographic Experts Group) method, and the like. Also, the compression/extraction unit 210 executes an extraction process to extract the image data compression—processed according to the various compression methods.

Figure 2:
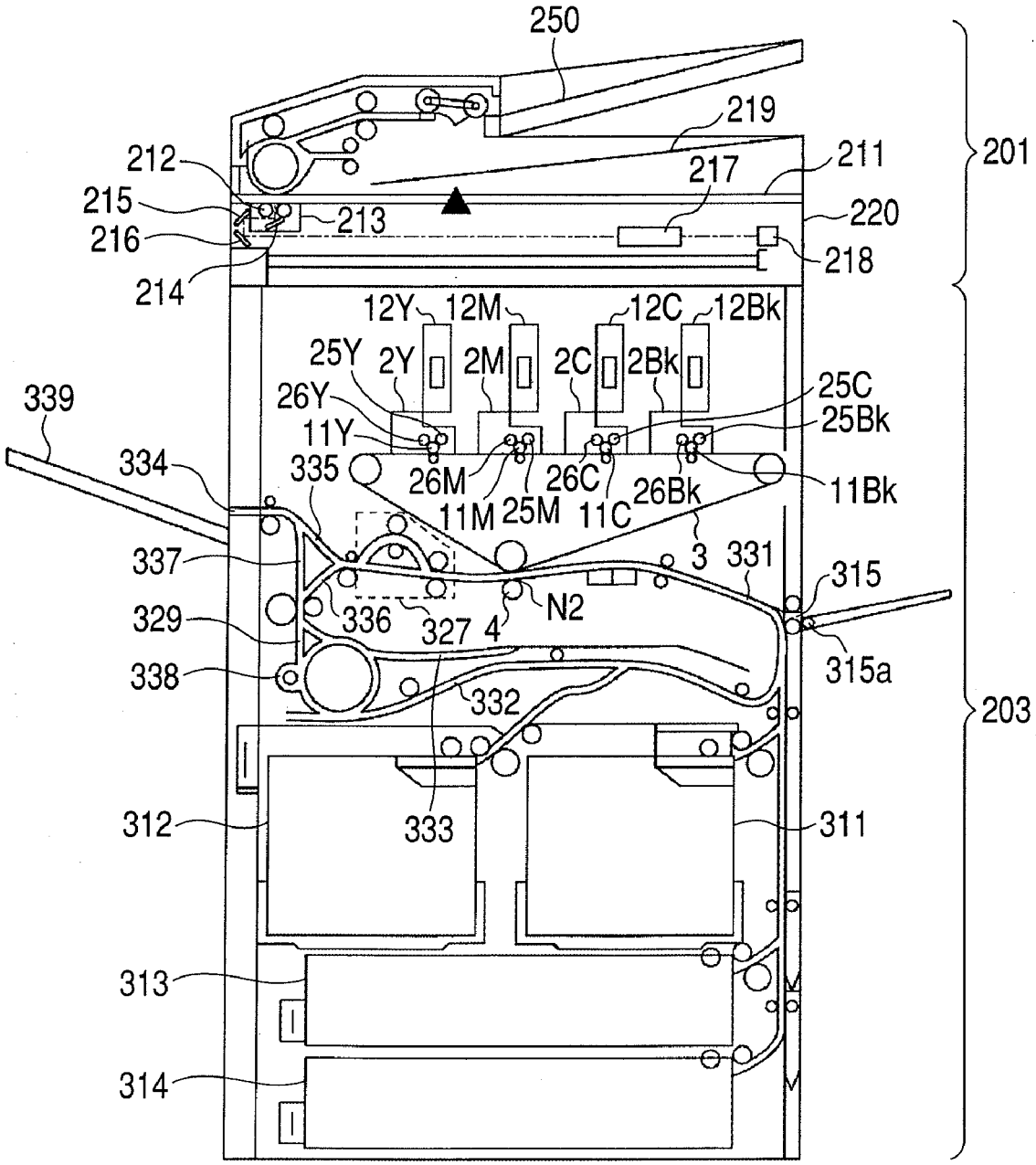
FIG. 2 is a diagram illustrating a hardware constitution of the printing device 100.

Subsequently, the hardware constitution of the printing device 100 will be described with reference to FIG. 2.

The printing device 100 roughly includes the scanner unit 201 and the printer unit 203. First, a sheaf of original sheets is loaded on an original feeding unit 250. Then, the scanner unit 201 feeds one by one the loaded original sheets from the head thereof (that is, the uppermost original sheet) in due order onto a platen glass 211. Subsequently, after the end of a reading operation by a scanner unit 220, the original feeding unit 250 discharges the original sheets to a discharge tray 219. If the original sheet is fed onto the platen glass 211, the scanner unit 201 turns on a lamp 212 and also moves an optical unit 213, so that the original sheet is illuminated and scanned from below the platen glass 211. Then, reflected light from the original sheet is guided into a CCD (charge coupled device) 218 which acts as an image sensor through plural mirrors 214, 215 and 216 and a lens 217, and an image on the scanned original sheet is read as image data by the CCD 218. Subsequently, the image data read by the CCD 218 is subjected to a predetermined image process, and the processed image data is stored in the HDD 209.

The printing device 100 executes the printing process by transferring a toner image of plural colors (yellow, cyan, magenta, and black) onto the sheet and then fixing the transferred toner image on the sheet by heat. Here, the printing device 100 includes plural printing units (that is, a printing unit 2Y, a printing unit 2M, a printing unit 2C, and a printing unit 2Bk) which primarily transfer the toner images of the respective colors onto an intermediate transfer belt 3.

Further, the printing device 100 includes the intermediate transfer belt 3 which is used to superpose the toner images and primarily transfer the superposed toner image to the printing units 2Y, 2M, 2C and 2Bk respectively. Furthermore, the printing device 100 includes a secondary transfer roller 4, which is used to secondarily transfer the toner images superposed and primarily transferred onto the intermediate transfer belt 3, to a sheet S (FIG. 4) at a secondary transfer position N2.

Incidentally, photosensitive drums 11Y, 11M, 11C and 11Bk are provided respectively in the printing units 2Y, 2M, 2C and 2Bk, and electrification units 25Y, 25M, 25C and 25Bk are provided respectively in regard to the photosensitive drums 11Y, 11M, 11C and 11Bk. Furthermore, laser scan units 12Y, 12M, 12C and 12Bk are provided respectively in the printing units 2Y, 2M, 2C and 2Bk. Here, each of the laser scan units 12Y, 12M, 12C and 12Bk irradiates a laser beam corresponding to an image signal to the photosensitive drum which has been uniformly electrified by the electrification unit and thus on which the potential has been uniformized, so as to form an electrostatic latent image on the photosensitive drum. Furthermore, development units 26Y, 26M, 26C and 26Bk are provided respectively in the printing units 2Y, 2M, 2C and 2Bk. Here, each of the development units 26Y, 26M, 26C and 26Bk develops, by using toner, the electrostatic latent image formed on the photosensitive drum.

The sheet S, which is fed from any one of cassettes 311, 312, 313 and 314, and a manual feeding tray 315, is transported to the secondary transfer position N2 through a transportation path 331 at timing synchronized with the start of irradiation of the laser beam. Here, a sheet sensor 315*a*, which detects that the sheet S is loaded, is provided in the manual feeding tray 315. The secondary transfer roller 4 is used to transfer the toner image (that is, a developer image) adhered on the intermediate transfer belt 3 onto the sheet S. Then, the sheet S to which the toner image has been transferred is transported to a fixing unit 327, and the transported sheet S is heated in the fixing unit 327, whereby the toner image on the sheet S is fixed thereto. Subsequently, the sheet S, to which the toner image has been fixed, is discharged to a discharge tray 339, which is provided outside the printing device 100, through a transportation path 335 and a sheet discharge unit 334. Incidentally, the detailed constitution of the fixing unit 327 will be later described with reference to FIG. 4. Besides, in a case where the sheet S is first inverted and then transported to the sheet discharge unit 334, the CPU 205 controls the printer unit 203 to guide the sheet S to transportation paths 336 and 338. Subsequently, the sheet S is transported in the reverse direction, and the transported sheet S is then discharged to the sheet discharge unit 334 through transportation paths 337 and 329.

Further, in a case where the printing process is executed to both the sides of the sheet S, the CPU 205 controls the printer unit 203 to guide the sheet S, that the toner image has been formed on its front surface (first side) at the secondary transfer position N2, to the transportation paths 336 and 333. Furthermore, the CPU 205 controls the printer unit 203 to transport the sheet S from the transportation path 333 to the transportation path 338 and further to transport the sheet S from a transportation path 332 to the transportation path 331. Thus, the sheet S is transported to the secondary transfer position N2 in the state that the front surface (first side) of the sheet S on which the toner image has been formed is face-down, and the toner image is formed on the back surface (second side) of the sheet S. Then, the CPU 205 transfers the toner image onto the back surface (second side) of the sheet S, and discharges the relevant sheet S to the sheet discharge unit 334 through the transportation path 335. Thus, the sheet S that the toner images have been formed on its both sides is discharged onto the discharge tray 339.

Subsequently, the detail of the fixing unit 327 will be described with reference to FIG. 4.

The fixing unit 327 includes a first fixing unit 401 and a second fixing unit 402, which act as the fixing unit to execute the fixing process to the toner image on the sheet by heating and pressurizing the relevant sheet. More specifically, since the second fixing unit 402 is usable to further execute the fixing process to the sheet on which the fixing process was executed by the first fixing unit 401, the second fixing unit 402 is provided on the downstream side of the first fixing unit 401. Thus, even in a case where the sheet such as a thick sheet (or thick paper) through which it is difficult to conduct heat is used, the printer unit 203 can execute, by using these two fixing units, the sufficient fixing process even if the sheet is transported at transportation speed equivalent to that in a case where the fixing process is executed to a plain sheet (or plain paper). Here, the first fixing unit 401 includes a heating roller 401*a* and a pressurizing roller 401*b*. Since the heating roller 401*a* further includes therein a heater, a fixing control unit 2009 (later described in FIG. 3) controls to drive the heater to maintain the set temperature of the heating roller 401*a*. When the sheet S, on which the toner image was formed at the secondary transfer position N2, passes between the heating roller 401*a* and the pressurizing roller 401*b*, the sheet S is heated by the heating roller 401*a*. At the same time, when the sheet S passes between the heating roller 401*a* and the pressurizing roller 401*b*, the sheet S is pressurized by the pair of the heating roller 401*a* and the pressurizing roller 401*b*. Besides, the second fixing unit 402 includes a heating roller 402*a* and a pressurizing roller 402*b*. Since the heating roller 402*a* further includes therein a heater, the fixing control unit 2009 controls to drive the heater to maintain the set temperature of the heating roller 402*a*. When the sheet S, to which the fixing process was executed by the first fixing unit 401, passes between the heating roller 402*a* and the pressurizing roller 402*b*, the sheet S is heated by the heating roller 402*a*. At the same time, when the sheet S passes between the heating roller 402*a* and the pressurizing roller 402*b*, the sheet S is pressurized by the pair of the heating roller 402*a* and the pressurizing roller 402*b*. Incidentally, the heater is provided in each of the heating rollers 401*a* and 402*a* in the present embodiment, the present invention is not limited to this. Namely, a heater may be provided also in each of the pressurizing rollers 401*b* and 402*b*.

Figure 3:
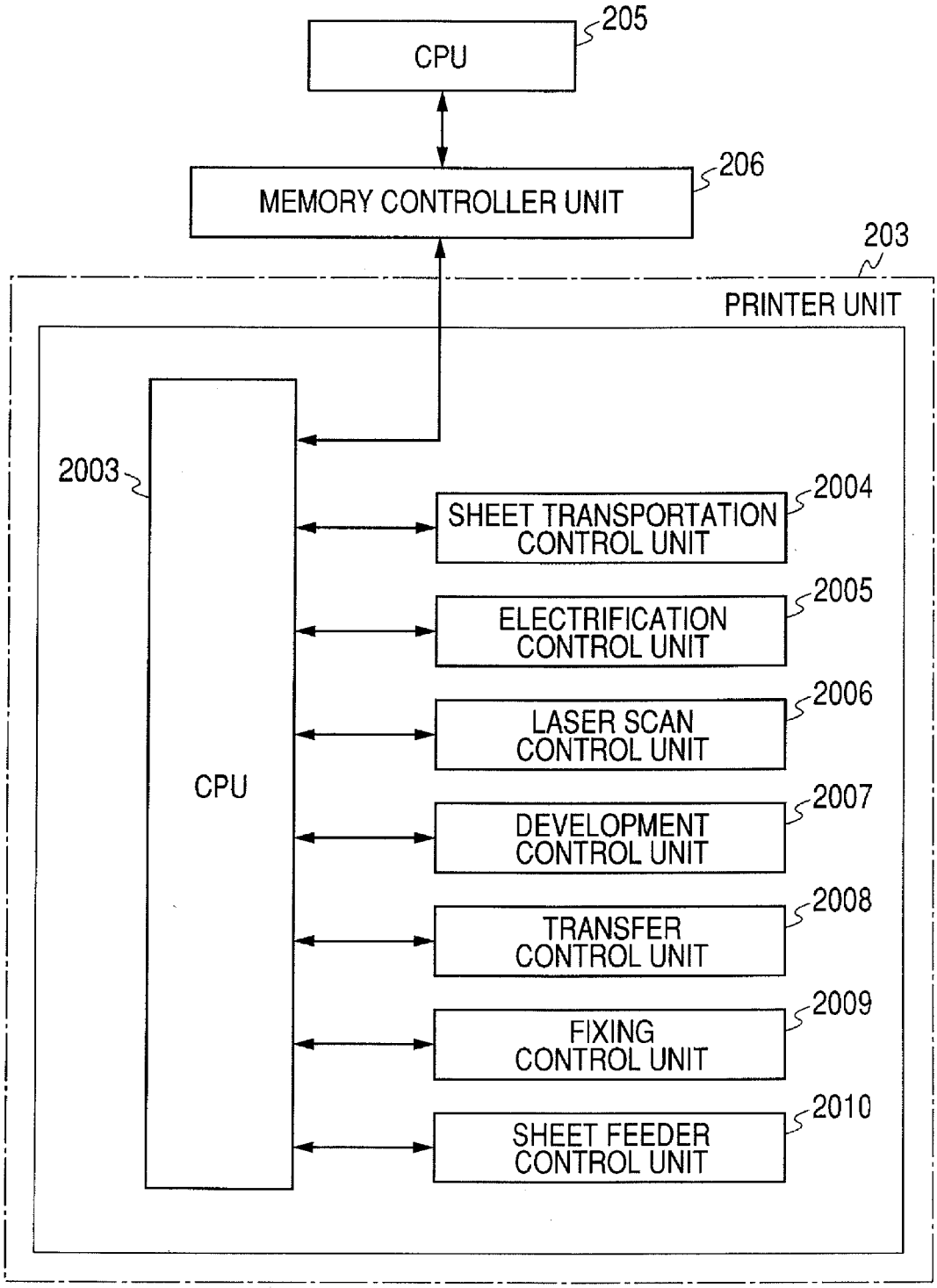
FIG. 3 is a block diagram illustrating a control constitution of a printer unit 203.
Figure 4:
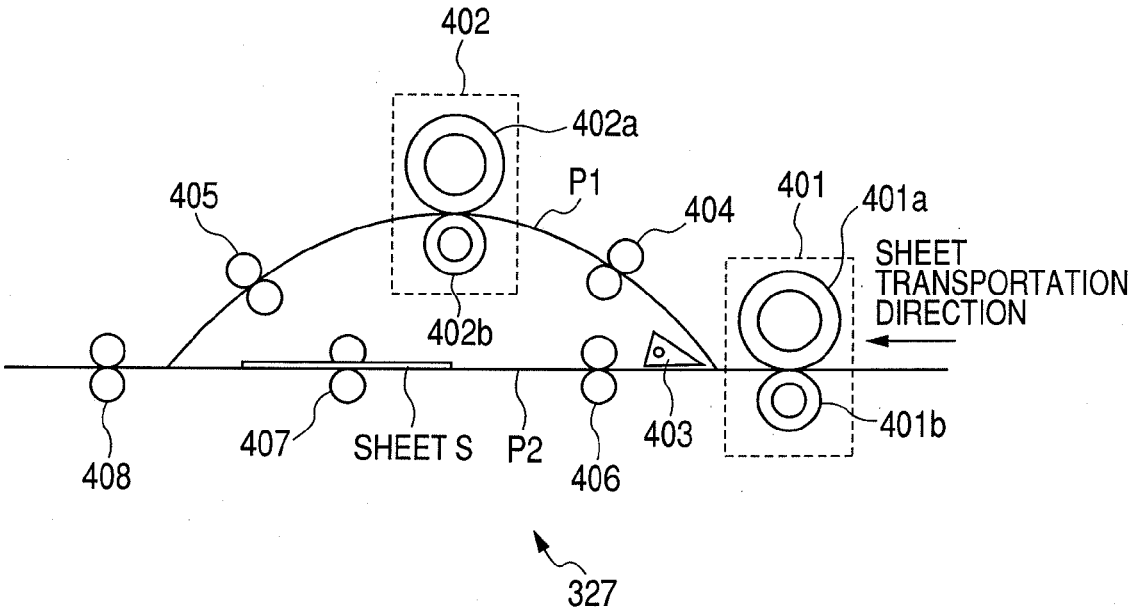
FIG. 4 is a diagram illustrating a constitution of a fixing unit 327.

In FIG. 4, a sheet transportation path P1 is used to pass the sheet S through both the first fixing unit 401 and the second fixing unit 402. On the other hand, a sheet transportation path P2 is used to pass the sheet S only the first fixing unit 401. That is, in the latter case, the sheet S does not pass the second fixing unit 401. In this connection, a flapper 403 is provided at the branch position between the sheet transportation path P1 and the sheet transportation path P2. Thus, a sheet transportation control unit 2004 (later described in FIG. 3) controls the flapper 403 to select whether to transport the sheet S, which passed the first fixing unit 401, to the sheet transportation path P1 or to the sheet transportation path P2.

In FIG. 4, pairs of sheet transportation rollers 404, 405, 406 and 407 are respectively rotated to transport the sheets in the sheet transportation direction. Then, the sheets which passed the sheet transportation path P1 and the sheets which passed the sheet transportation path P2 are further transported by a pair of sheet transportation rollers 408, and the transported sheets are discharged to the sheet discharge unit 334 through the transportation path 335.

Subsequently, the control constitution of the printer unit 203 in the printing device 100 according to the first embodiment will be described with reference to FIG. 3.

In the printing device 100, the printer unit 203 and the CPU 205 can mutually communicate with each other through the memory controller unit 206. Thus, a CPU 2003 in the printer unit 203 receives, from the memory controller unit 206, the image data and a command for executing the printing process, interprets the received image data, converts the interpreted image data into bit data, and also analyzes the received command.

The printer unit 203 includes the CPU 2003 and various control units which are controlled by the CPU 2003. More specifically, the various control units include the sheet transportation control unit 2004 which controls the sheet transportation rollers in the printing device 100 to transport the sheet S, and an electrification control unit 2005 which controls voltage to be applied to the electrification units 25Y, 25M, 25C and 25Bk so as to electrify each of the photosensitive drums 11y, 11M, 11C and 11Bk at predetermined potential. Further, the various control units of the printer unit 203 include a laser scan control unit 2006 which controls laser scan to expose the surface of each of the photosensitive drums 11Y, 11M, 11C and 11Bk based on the image data received by the CPU 2003 from the memory controller unit 206. Furthermore, the various control units of the printer unit 203 include a development control unit 2007 which controls the development units 26Y, 26M, 26C and 26Bk to develop the electrostatic latent images respectively formed on the respective surfaces of the photosensitive drums 11Y, 11M, 11C and 11Bk. Furthermore, the various control units of the printer unit 203 include a transfer control unit 2008 which controls transfer voltage to be applied to the secondary transfer roller 4 to transfer the toner image formed on the intermediate transfer belt 3 to the sheet S. Furthermore, the various control units of the printer unit 203 include the fixing control unit 2009 which controls rotation of the pairs of the rollers constituting the fixing unit 327 and power to be supplied to the heater included in at least one of the rollers constituting each pair, so as to fix the toner image on the sheet S to which the toner image has been secondarily transferred. Furthermore, the various control units of the printer unit 203 include a sheet feeder control unit 2010 which controls driving of the rollers provided in the cassettes 311, 312, 313 and 314, so as to feed the sheet S to the secondary transfer position N2.

Figure 5:
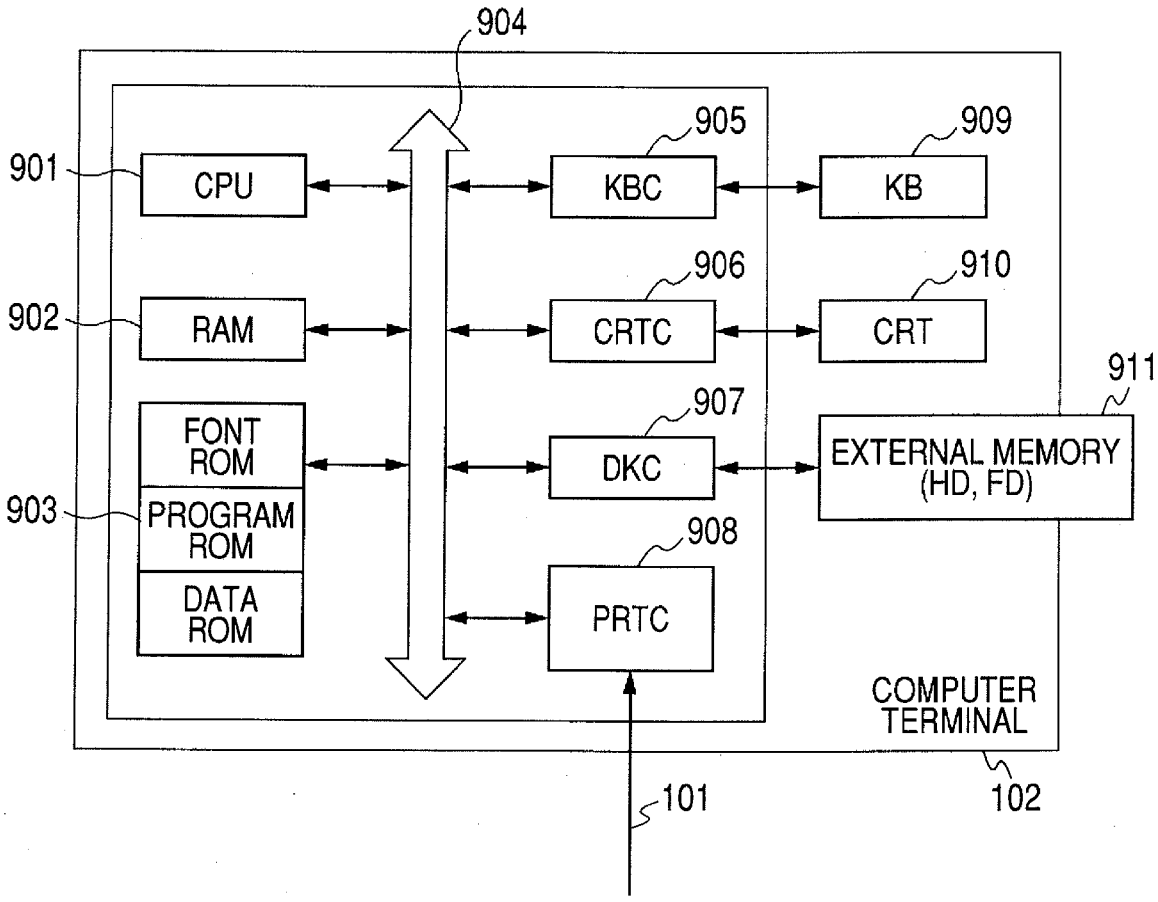
FIG. 5 is a block diagram illustrating a control constitution of a computer terminal 102.

Subsequently, the constitution of the computer terminal 102 according to the first embodiment will be described with reference to FIG. 5. In FIG. 5, the computer terminal 102 includes a CPU 901 which executes a text process mixedly containing figures, images, characters, tables (including spreadsheets, etc.) and the like, based on a text process program or the like stored in a program ROM of a ROM 903 or an external memory 911. Further, the CPU 901 totally controls respective bus devices (bus units) which are connected to a system bus 904. Incidentally, an OS (operating system) which acts as a control program for the CPU 901, later-described printer drivers, and the like have been stored in the program ROM of the ROM 903 or the external memory 911, font data and the like which are used in the text process have been stored in a font ROM of the ROM 903 or the external memory 911, and various data which are used in the text process and the like have been stored in a data ROM of the ROM 903 or the external memory 911. Besides, a RAM 902 functions as a main memory, a working area and the like for the CPU 901.

A KBC (keyboard controller) 905 controls key inputting from a KB (keyboard) 909 and a not-illustrated pointing device, a CRTC (CRT controller) 906 controls display on a CRT (cathode ray tube) 910, and a DKC (disk controller) 907 controls accessing between the computer terminal 102 and the external memory 911 such as an HD (hard disk), an FD (floppy disk) or the like. The external memory 911 stores therein a boot program, various applications, a printer control command generation program (that is, a printer driver), and the like, and a PRTC (printer controller) 908, which is connected to the printing device 100 through the network 101, executes a communication control process between the computer terminal 102 and the printer device 100.

Figure 6:
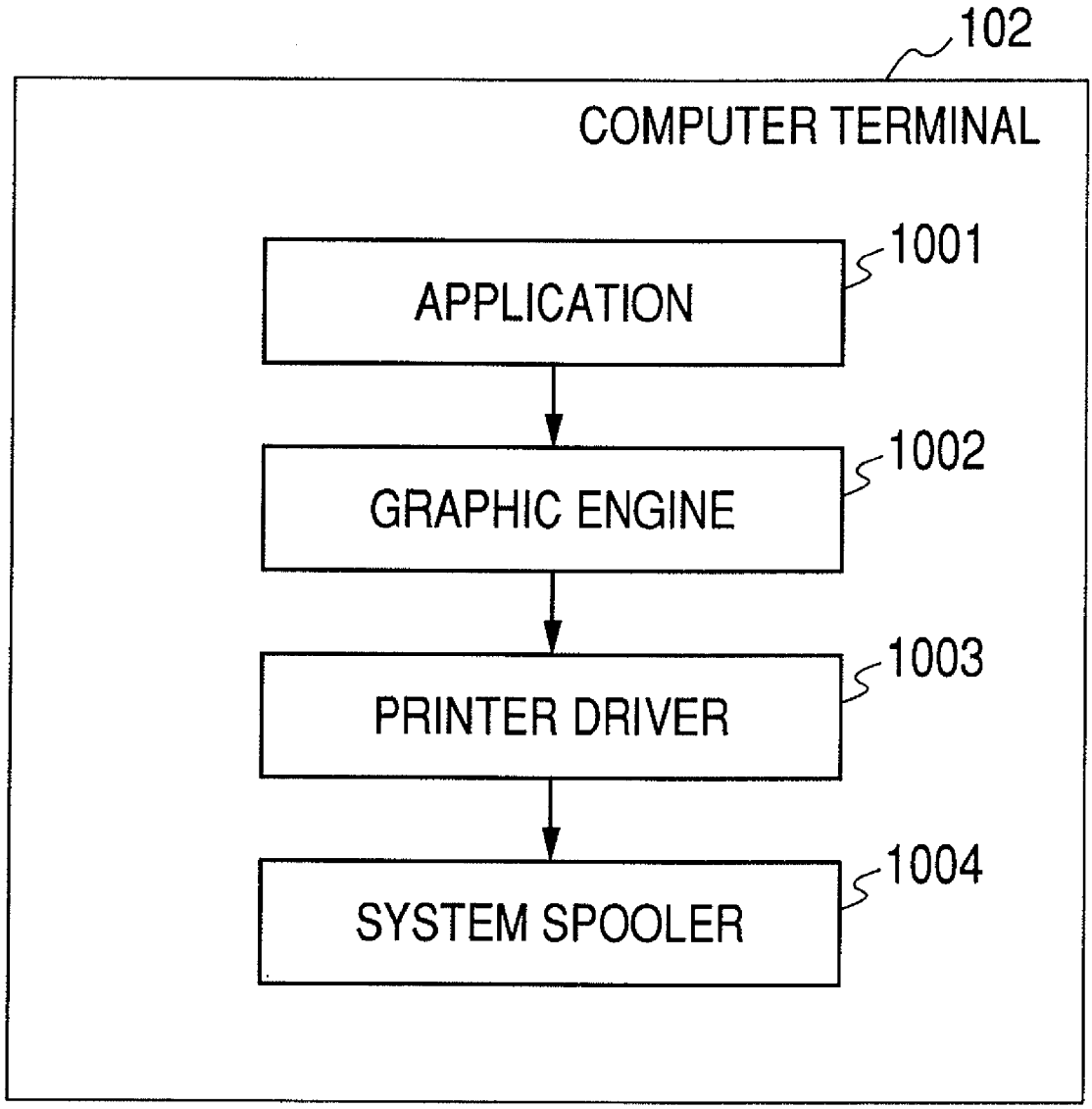
FIG. 6 is a block diagram illustrating a software configuration in the computer terminal 102.

FIG. 6 is a block diagram illustrating a software configuration in the computer terminal 102. More specifically, an application 1001, a graphic engine 1002, a printer driver 1003 and a system spooler 1004 exist as software programs stored in the external memory 911.

The application 1001 stored in the external memory 911 is loaded into the RAM 902, and the loaded application 1001 is then executed. When the print job is transferred from the application 1001 to the printing device 100, an output process (that is, image drawing) is executed by using the graphic engine 1002 which has been loaded and is executable in the RAM 902.

The data, which was output by the graphic engine 1002, is transferred to the printer driver 1003. Here, the printer driver 1003 is loaded from the external memory 911 into the RAM 902, and the loaded printer driver 1003 is then executed by the CPU 901. Subsequently, the printer driver 1003 converts the data transferred from the graphic engine 1002 into a control command (for example, a PDL command) which can be interpreted by the printing device 100. The control command is output to the printing device 100 by the system spooler 1004, which has been loaded into the RAM 902 by the OS, through the network 101. Here, it should be noted that the control command like this is called the print job (that is, the image formation job).

Incidentally, to generate the print job by the printer driver 1003, it is necessary to set an image formation condition in the printing device. Here, it should be noted that the image formation condition in this case indicates a combination of printing setting items such as a kind of sheet to be used in the printing process, designation of two-sided copying or one-sided copying, and the like. More specifically, the image formation condition is typically set from a window (that is, a window to be displayed on the CRT 910) which is provided by the printer driver 1003. Then, the printer driver 1003 adds the contents, which are set by the user of the computer terminal 102 through the window, to the print job as image formation condition information.

Figure 7:
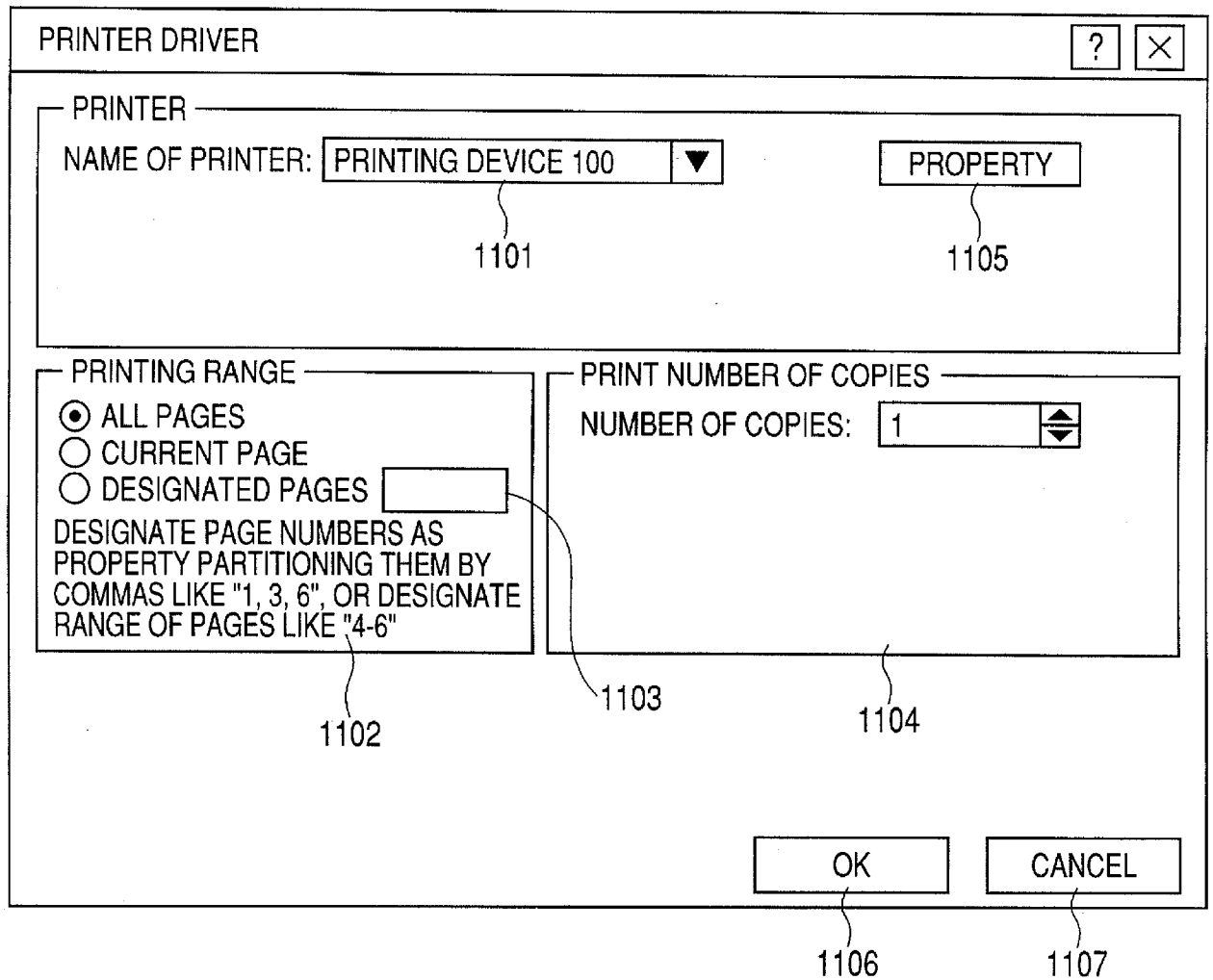
FIG. 7 is a diagram illustrating a window to be used to cause a printer driver 1003 to set an image formation condition.

FIG. 7 is a diagram illustrating the window to be used to cause the printer driver 1003, which has been installed in the computer terminal 102, to set the image formation condition.

In a case where a document text is created by the application 1001, the computer terminal 102 activates the printer driver 1003 to cause the CRT 910 to display the setting screen illustrated in FIG. 7.

On the setting screen illustrated in FIG. 7, an operator (that is, a user) of the computer terminal 102 operates a printer name selection box 1101 by using the not-illustrated pointing device or the like. By doing so, the printing device 100 or another printing device is selected as the transmission destination to which the computer terminal 102 transmits the print job. In FIG. 7, the user of the computer terminal 102 selects the printing device 100. Further, the operator of the computer terminal 102 operates a printing range selection box 1102 by using the not-illustrated pointing device or the like. By doing so, a desired page (or pages) in the document text, which was created by the application 1001, is determined as the range to be printed by the printing device 100. More specifically, if the operator selects "all", the printer driver 1003 sets all the pages of the document text created by the application 1001, as the printing target. Further, if the operator selects "current page", the printer driver 1003 sets, in the document text created by the application 1001 and having plural pages, the page, which is currently displayed on the CRT 910, as the printing target. Furthermore, if the operator selects "designated pages", the printer driver 1003 sets, in the document text created by the application 1001 and having plural pages, the pages (or page), which are manually input in an edit box 1103, as the printing target. Besides, the printer driver 1003 sets the number of copies, which was manually input in a print number of copies setting box 1104 by the operator, as the number of copies to be printed.

Then, if the setting of the image formation condition of the print job to be transmitted to the printing device 100 ends, the operator of the computer terminal 102 selects an OK button 1106. By doing so, the printer driver 1003 starts to generate the print job. Incidentally, if the operator of the computer terminal 102 wishes to stop the generation of the print job, he/she selects a cancel button 1107.

Figure 8:
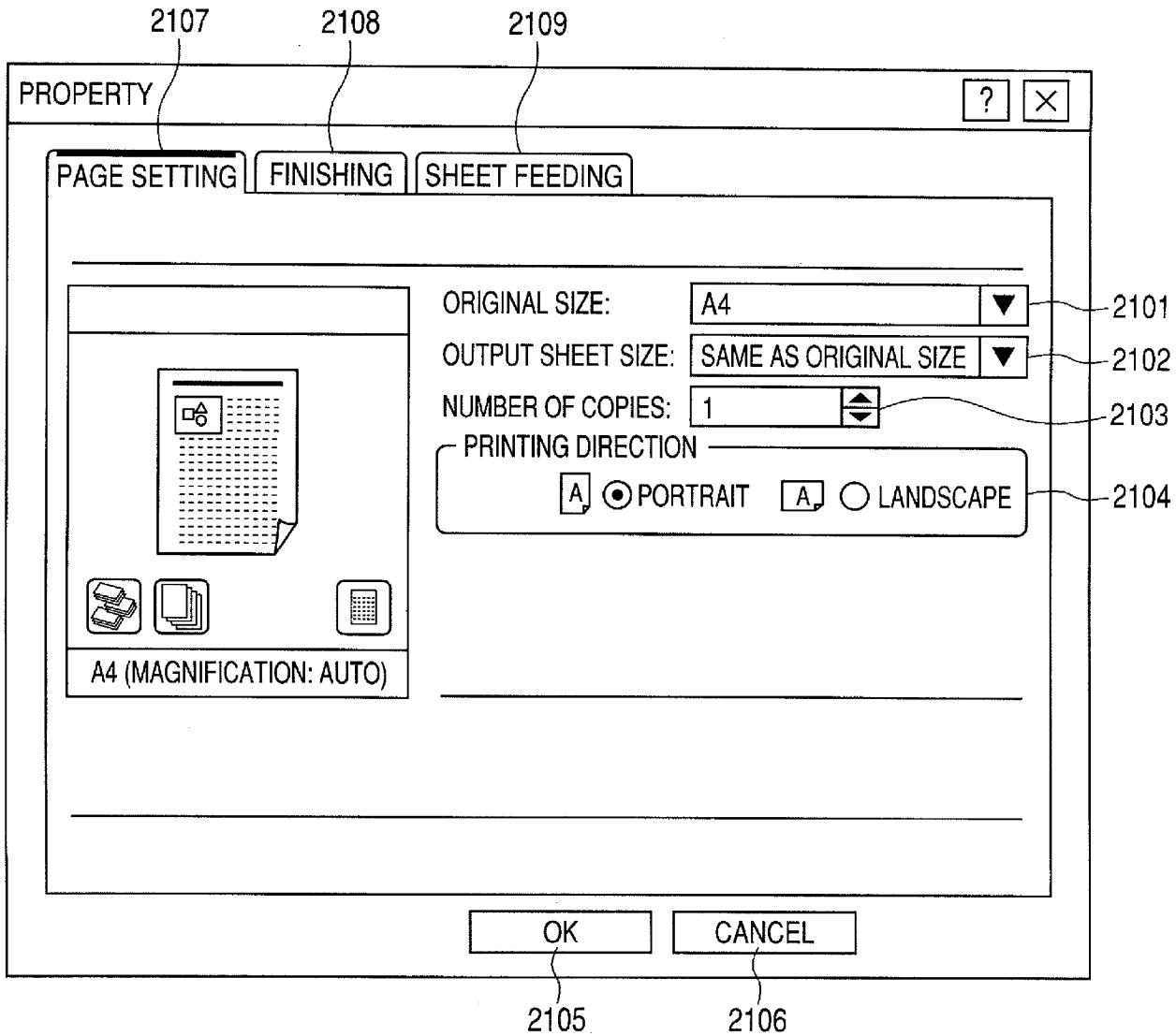
FIG. 8 is a diagram illustrating a screen to be displayed when a property button 1105 is selected on a property setting screen.

FIG. 8 is a diagram illustrating a screen to be displayed when a property button 1105 is selected on the property setting screen of the printer driver illustrated in FIG. 7. Here, it should be noted that FIG. 8 indicates the state that a page setting tab 2107 is being selected.

The operator of the computer terminal 102 operates an original size selection box 2101 by using the not-illustrated pointing device or the like, whereby the printer driver 1003 selects the original size of each page in the document text which is to be edited by the application 1001. Incidentally, since the original size has been normally designated in the document text which is to be edited by the application 1001, the relevant original size is automatically selected (that is, "A4 size" in FIG. 8). Further, if the operator selects "same as original size" in an output sheet size selection box 2102, the printer driver 1003 selects "A4 size" as the size of the sheet which is to be used in the printing process (that is, the output process). Incidentally, it should be noted that the operator can select, as the output sheet size, a desired size such as "A3 size", "B5 size" and the like in addition to "same as original size". However, in this case, since the sheet size which is different from the original size is selected, the printer driver 1003 has to generate the print job by appropriately changing a print magnification. Further, if the operator inputs the desired number of copies in a print number of copies selection box 2103, the printer driver 1003 sets the input number of copies to the print job. Furthermore, if the operator selects a desired printing direction in a printing direction designation box 2104, the printer driver 1003 sets the input printing direction to the print job.

Subsequently, if the operator selects an OK button 2105, the values which have been input respectively in the original size selection box 2101, the output sheet size selection box 2102, the print number of copies selection box 2103 and the printing direction designation box 2104 are decided. On the other hand, if the operator selects a cancel button 2106, the values which have been input respectively in the original size selection box 2101, the output sheet size selection box 2102, the print number of copies selection box 2103 and the printing direction designation box 2104 are not decided. In the latter case, the setting in each of the boxes is returned to predetermined initial setting.

Figure 9:
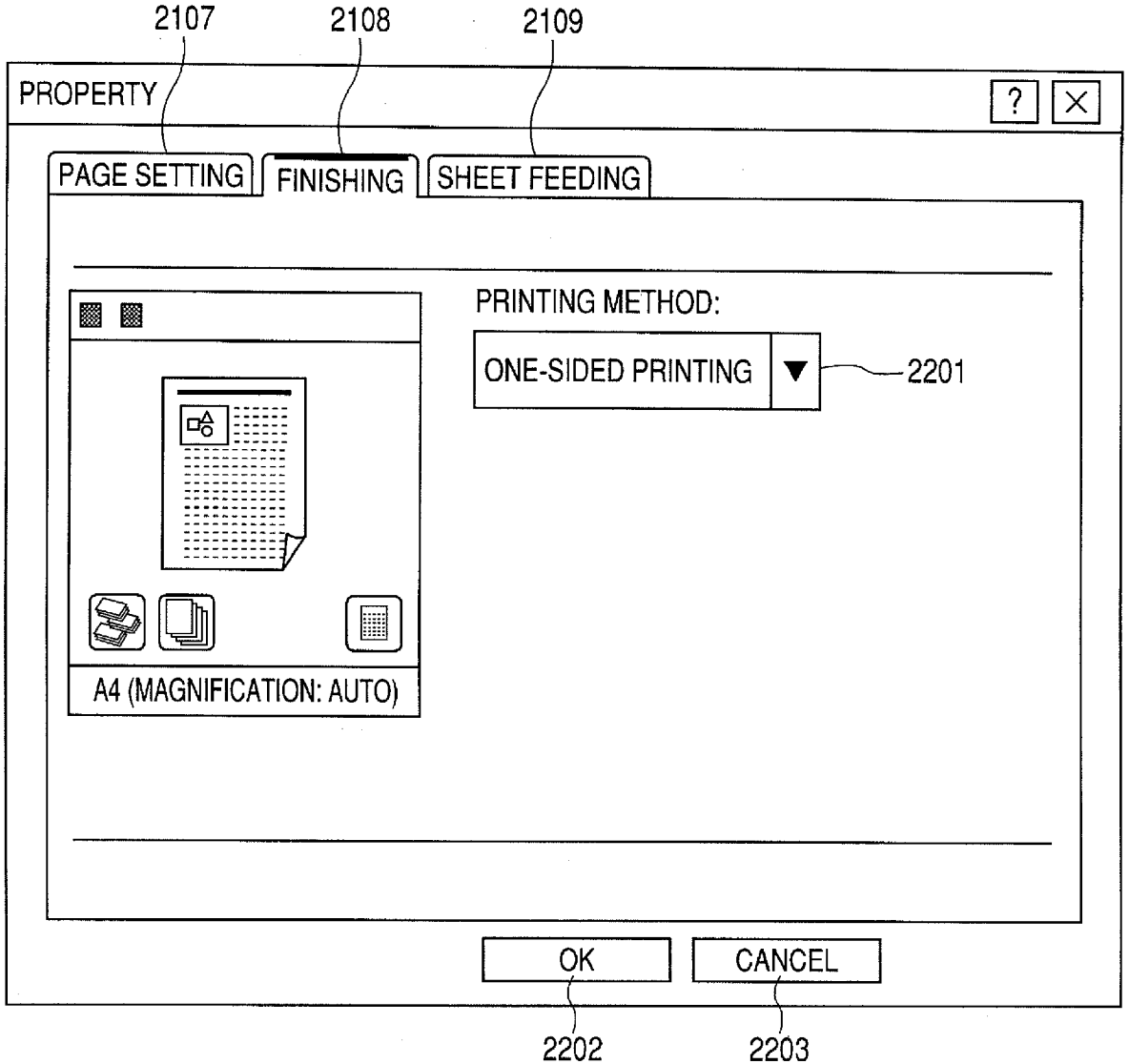
FIG. 9 is a diagram illustrating a screen to be displayed when a finishing tab 2108 is selected on the property setting screen.

FIG. 9 is a diagram illustrating a screen to be displayed when a finishing tab 2108 is selected on the property setting screen displayed by the printer driver 1003 illustrated in FIG. 8.

The operator of the computer terminal 102 operates a printing method selection box 2201 by using the not-illustrated pointing device or the like, whereby the printer driver 1003 selects the printing method (that is, one of the image formation conditions) which is to be used when the printing process based on the print job is executed by the printing device 100. Incidentally, it should be noted that the printing method includes "one-sided printing" in which the printing process is executed to only one side of a sheet (FIG. 9), and "double-sided printing" in which the printing process is executed to both the sides of a sheet.

Then, if the operator selects an OK button 2202, the value which has been input in the printing method selection box 2201 is decided. On the other hand, if the operator selects a cancel button 2203, the value which has been input in the printing method selection box 2201 is not decided. In the latter case, the setting in the printing method selection box 2201 is returned to predetermined initial setting.

Figure 10:
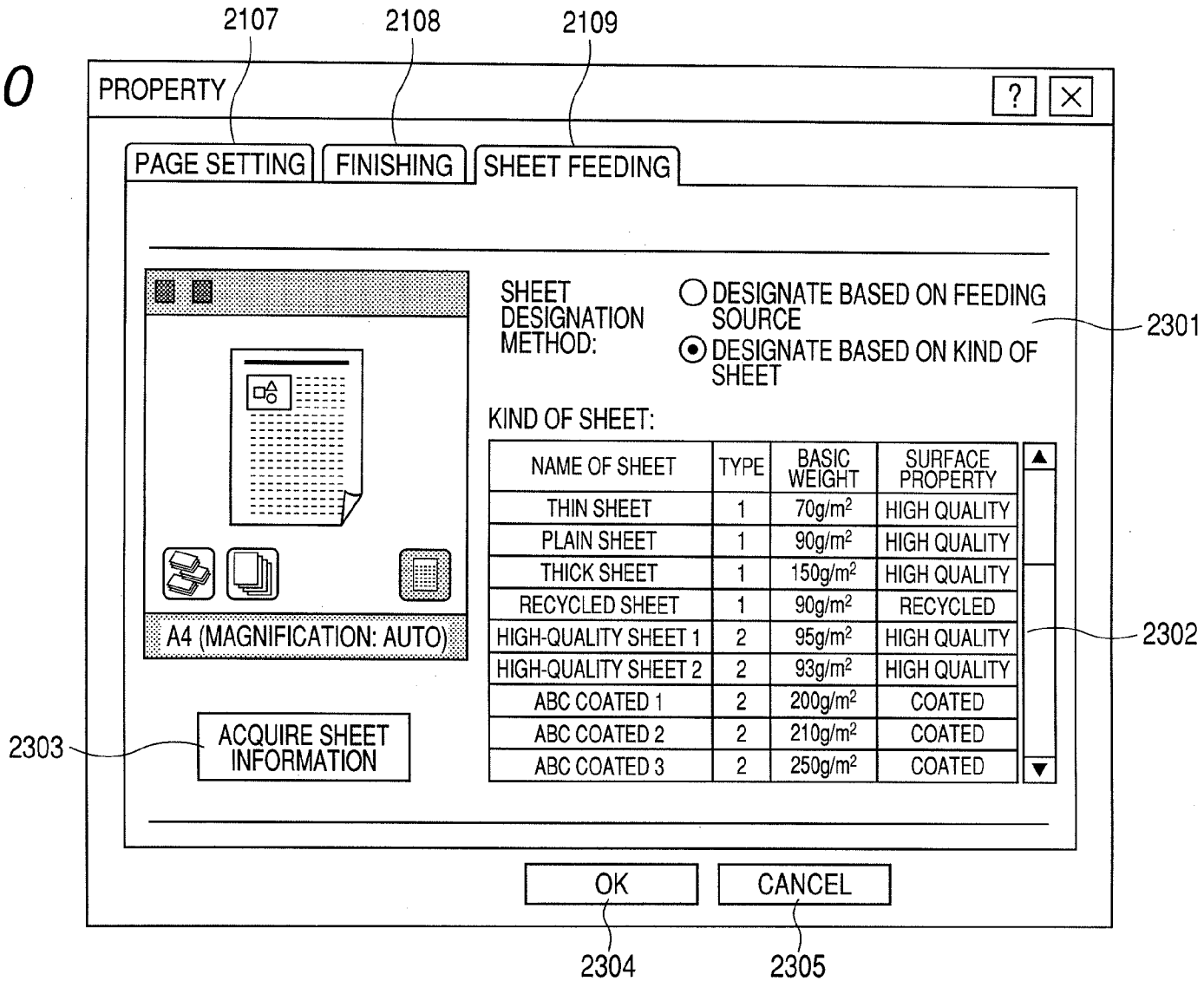
FIG. 10 is a diagram illustrating a screen to be displayed when a sheet feeding tab 2109 is selected on the property setting screen.

FIG. 10 is a diagram illustrating a screen to be displayed when a sheet feeding tab 2109 is selected on the property setting screen displayed by the printer driver 1003 illustrated in FIG. 8.

The operator of the computer terminal 102 operates a sheet feeding method selection box 2301 by using the not-illustrated pointing device or the like, whereby the printer driver 1003 selects a sheet designation method which is to be used when the printing process is executed by the printing device 100. Incidentally, it should be noted that, in FIG. 10, a method of designating a sheet based on a kind of sheet is selected as the sheet designation method. Then, if the method of designating the sheet based on the kind of sheet is selected, a table 2302 for designating the kind of sheet is displayed. Thus, the operator of the computer terminal 102 designates, from the table 2302 by using the pointing device, the kind of sheet to be used in the printing process which is executed based on the print job. Then, if the operator selects an OK button 2304, the selected kind of sheet is decided. On the other hand, if the operator selects a cancel button 2305, the selected kind of sheet is not decided. In the latter case, the setting is returned to predetermined initial setting. Incidentally, if the operator selects a button 2303, it is possible to acquire sheet information of various kinds of sheets.

On the property setting screen, if the settings as illustrated in FIGS. 8, 9 and 10 end by the printer driver (that is, if the OK buttons 2105, 2202 and 2304 are selected), the screen is returned to the setting screen of the printer driver illustrated in FIG. 7.

Then, if the OK button 1106 on the setting screen of the printer driver illustrated in FIG. 7 is selected, an external device (that is, the computer terminal 102) generates a print job by synthesizing the contents set on the property setting screen and application data. Subsequently, the computer terminal 102 transmits the print job to the printing device 100.

Figure 11:
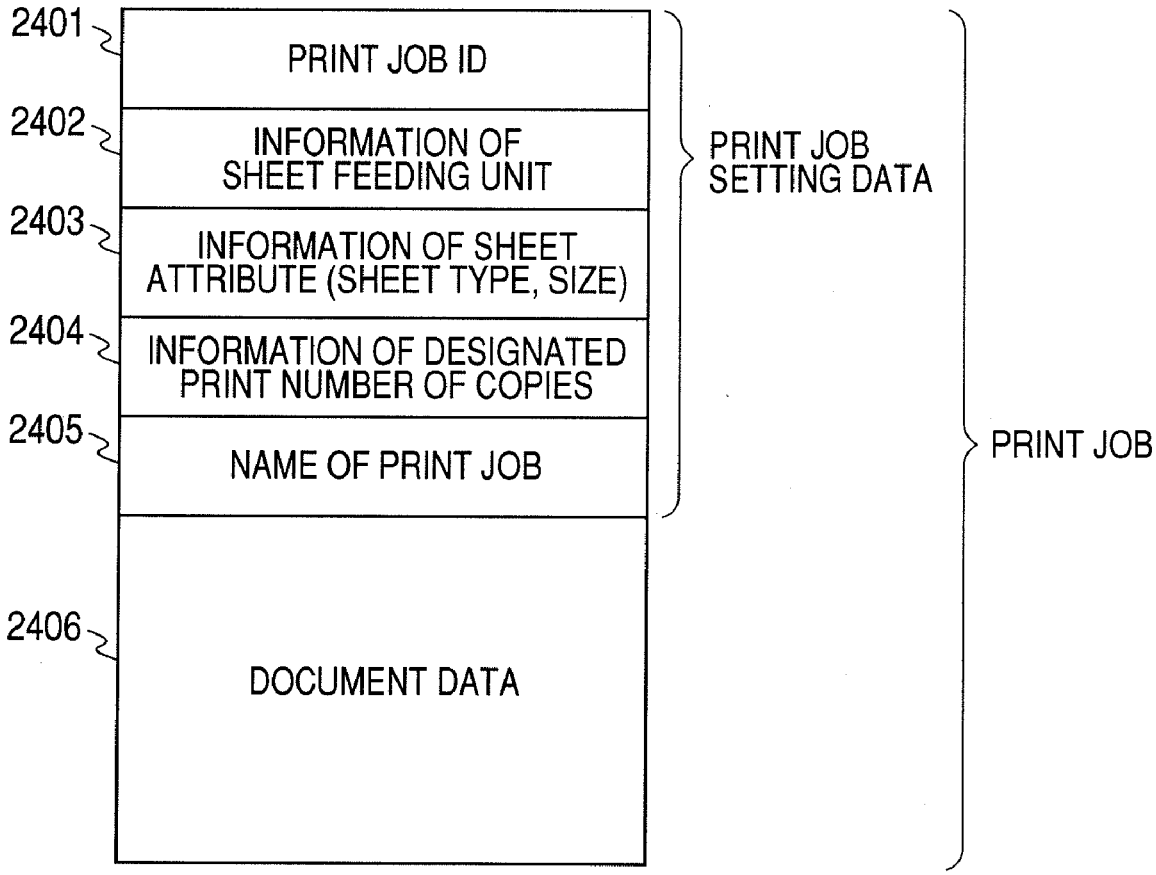
FIG. 11 is a diagram illustrating a data configuration of a print job to be transmitted from the computer terminal 102 to the printing device 100.

Incidentally, a concrete example of a data configuration of the print job is illustrated in FIG. 11.

That is, FIG. 11 is the diagram illustrating the data configuration of the print job to be transmitted from the computer terminal 102 to the printing device 100.

In FIG. 11, print job ID 2401 is a unique ID which is given to the print job when the relevant print job is transmitted from the computer terminal 102 to the printing device 100. More specifically, the print job ID 2401 is used to be able to identify the relevant print job on the side of the printing device 100. Information 2402 of the sheet feeding unit (hereinafter, called sheet feeding unit information) identifies the sheet feeding unit which is selected in a sheet feeding unit selection box (that is, the box which is displayed when "designate based on feeding source" is selected in the sheet feeding method selection box 2301). Information 2403 of the sheet attribute (hereinafter, called sheet attribute information) includes sheet size information which specifies the output sheet size selected in the output sheet size selection box 2102. In addition, the sheet attribute information 2403 includes sheet kind information which indicates the kind of sheet selected from the table 2302 illustrated in FIG. 10.

Information 2404 of the designated print number of copies (hereinafter, called designated print number of copies information) identifies the print number of copies which was input in the print number of copies setting box 1104, and a name 2405 of the print job (hereinafter, called a print job name) to which the text data indicating a file name necessary in case of administration by the application is given as the print job name. Document data 2406 indicates a document (document text) which is created based on the application operating on the computer terminal 102.

Incidentally, it should be noted that the document data is configured by image data of one or more pages, and, in the first embodiment, the sheet feeding unit information 2402 and the sheet attribute information 2403 are provided in common used for all pages of the job.

Subsequently, the operation which is executed by the printing device 100, which received the print job from the computer terminal 102, will be described with reference to a flow chart illustrated in FIG. 12.

Figure 12:
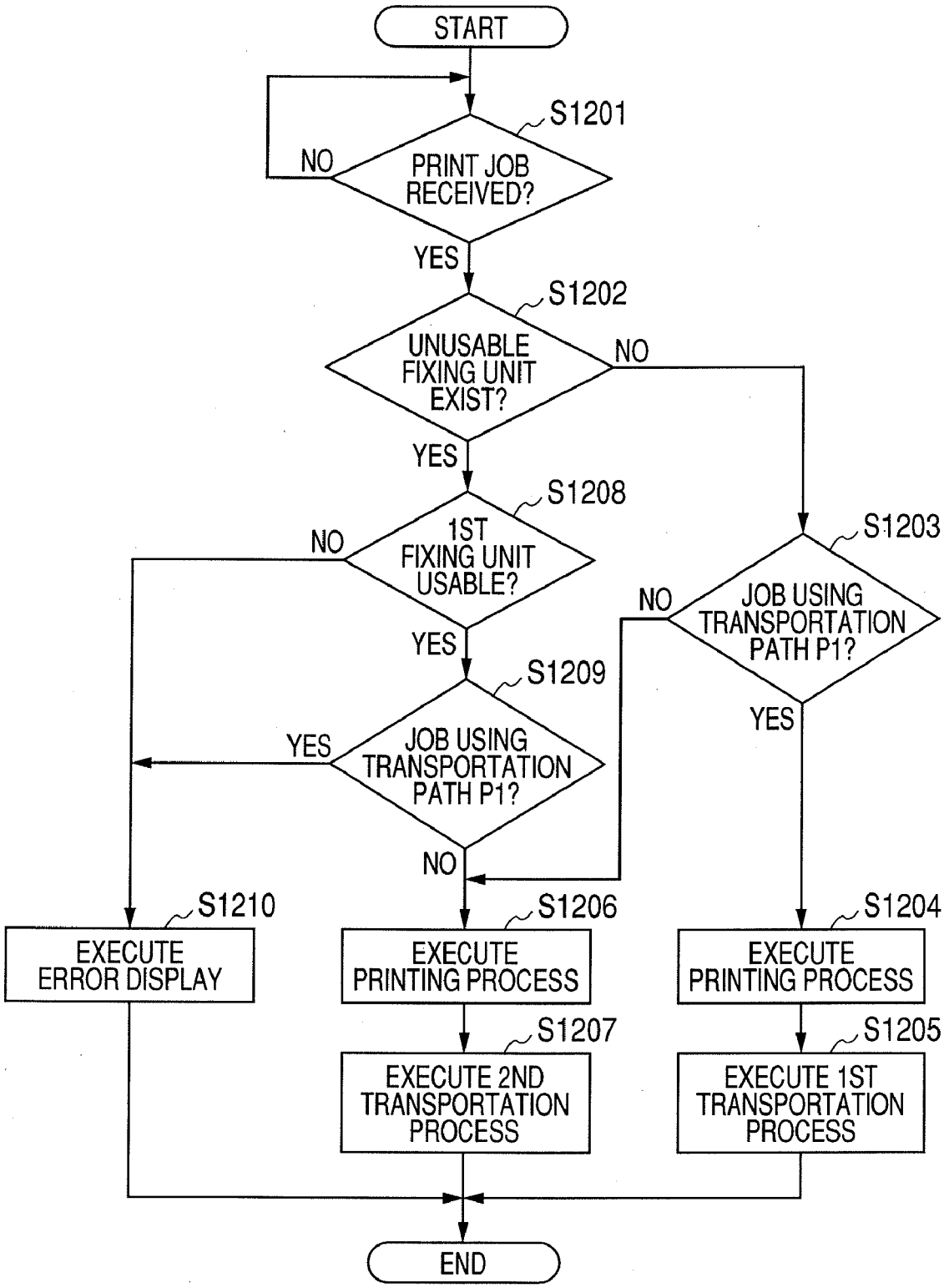
FIG. 12 is a flow chart illustrating an operation to be executed by the printing device 100.

In a step S1201 of FIG. 12, it is determined by the CPU 205 whether or not the print job is received from the computer terminal 102. If it is determined that the print job is received from the computer terminal 102, the flow advances to a step S1202.

In the step S1202, it is determined by the CPU 205 whether or not there is an unusable fixing unit. Here, if it is determined that there is no unusable fixing unit, the flow advances to a step S1208. On the other hand, if it is determined that there is no unusable fixing unit, the flow advances to a step S1203. Incidentally, the fixing unit here indicates the first fixing unit 401 or the second fixing unit 402 which are illustrated in FIG. 4, and a case where the fixing unit cannot be used includes following cases:

(1) a case where abnormality occurs in the fixing unit.

(2) a case where it has been set not to use the fixing unit.

(3) a case where sheet transportation abnormality occurs on the sheet transportation path P1 or the sheet transportation path P2.

In regard to the case (1), the fixing control unit 2009 detects occurrence of abnormality that a roller of the fixing unit does not rotate, occurrence of abnormality of the heater in the fixing unit, and the like. Then, the CPU 205 determines, based on a detected result by the fixing control unit 2009, whether or not the fixing unit can be used. In regard to the case (2), if the operator of the printing device 100 has set, through the operation unit 204, not to use the fixing unit due to maintenance or the like of the fixing unit, the CPU 205 determines that the fixing unit cannot be used. In regard to the case (3), based on an output from the sensor which is provided on each of the sheet transportation path P1 and the sheet transportation path P2 to detect whether or not a sheet exists thereon, the CPU 205 determines whether or not the fixing unit can be used.

In the step S1203, it is determined by the CPU 205, based on the image formation condition information added to the print job received from the computer terminal 102, whether the print job is to transport the sheet on the sheet transportation path P1 or to transport the sheet on the sheet transportation path P2. Here, a table which is used by the CPU 205 to execute the determination in the step S1203 will be described with reference to FIG. 13.

FIG. 13 is the diagram illustrating information relevant to attributes of the sheets to be used by the printing device 100 in the printing process. More specifically, in FIG. 13, the information which indicates what kind of image formation condition has been made correspondent to each of certain specific kinds of sheets is displayed in the form of table. Incidentally, the sheet attribute information 2403 has been added, as the image formation condition information, to the print job which is received from the computer terminal 102. Thus, it is determined by the CPU 205 whether or not the received print job is the job in which the sheet transportation path P1 is used, based on the sheet attribute information 2403 added to the received print job and the information on the table illustrated in FIG. 13. For example, if the information indicating a "plain sheet" has been added as the sheet attribute information 2403 to the print job, it is determined by the CPU 205 that the print job is the job in which the sheet transportation path P2 is used. Then, if it is determined by the CPU 205 that the print job received in the step S1201 is the job in which the sheet transportation path P1 is used, the flow advances to a step S1204. On the other hand, if it is determined by the CPU 205 that the received print job is the job in which the sheet transportation path P2 is used, the flow advances to a step S1206.

In the step S1204, the CPU 205 causes the printer unit 203 to execute the printing process based on the print job, and the flow advances to a step S1205.

In the step S1205, the CPU 205 causes the printer unit 203 to execute a first transportation process. Here, it should be noted that the first transportation process is the process to transport the sheet S on the sheet transportation path P1, and thus to execute both the fixing process by the first fixing unit 401 and the fixing process by the second fixing unit 402 to the sheet S. Incidentally, when the first transportation process is executed, the fixing control unit 2009 controls temperature based on the information on the table illustrated in FIG. 13. For example, with respect to the print job to which the information indicating a thick sheet (or thick paper) has been added as the sheet attribute information 2403, the fixing control unit 2009 sets the temperature in the fixing process by the first fixing unit 401 to 180° C., and also sets the temperature in the fixing process by the second fixing unit 402 to 180° C. In the present embodiment, the process in the step S1205 is executed after the process in the step S1204 is executed. However, if the print job includes the document data of plural pages, the processes in the steps S1204 and S1205 are executed respectively to different pages in parallel.

If in the step S1203 the CPU determined that the print job received in step S1201 is a print job for which the sheet transportation path P2 is to be used, the process flow moves to step S1206. In the step S1206, the CPU 205 causes the printer unit 203 to execute the printing process based on the print job, and the flow advances to a step S1207.

In the step S1207, the CPU 205 causes the printer unit 203 to execute a second transportation process. Here, it should be noted that the second transportation process is the process to transport the sheet S on the sheet transportation path P2, and thus to execute only the fixing process by the first fixing unit 401 to the sheet S. Incidentally, when the second transportation process is executed, the fixing control unit 2009 controls temperature based on the information on the table illustrated in FIG. 13. For example, with respect to the print job to which the information indicating a "plain sheet" has been added as the sheet attribute information 2403, the fixing control unit 2009 sets the temperature in the fixing process by the first fixing unit 401 to 185° C. In the present embodiment, the process in the step S1207 is executed after the process in the step S1205 is executed. However, if the print job includes the document data of plural pages, the processes in the steps S1206 and S1207 are executed respectively to different pages in parallel.

Subsequently, a case where it is determined in the step S1202 that an unusable fixing unit (that is, a fixing unit which cannot be used) exists in the printing device 100 will be described hereinafter.

In the step S1208, it is determined by the CPU 205 whether or not the first fixing unit 401 can be used, based on the determination result in the step S1202. Then, if it is determined by the CPU 205 that the first fixing unit 401 can be used, the flow advances to a step S1209. On the other hand, if it is determined by the CPU 205 that the first fixing unit 401 cannot be used, the flow advances to a step S1210.

In the step S1209, as in the process in the step S1203, it is determined by the CPU 205 whether or not the print job is the job in which the sheet transportation path P1 is used. Then, if it is determined by the CPU 205 that the print job is the job in which the sheet transportation path P2 is used, the flow advances to the step S1206. On the other hand, if it is determined by the CPU 205 that the print job is the job in which the sheet transportation path P1 is used, the flow advances to the step S1210.

In the step S1210, the CPU 205 executes an error display on the operation unit 204 so as to indicate that, since the print job which was received from the computer terminal 102 in the step S1201 cannot be executed, it is necessary to enable to use the fixing unit. Here, the print job for which the error display is executed is stored in the HDD 209. Then, the process flow illustrated in FIG. 12 is repeated until the fixing unit becomes usable with respect to the stored print job.

Incidentally, it is assumed that the CPU 205 executes the process flow illustrated in FIG. 12 every time the print job is received from the computer terminal 102. For example, in a case where the second fixing unit 402 cannot be used due to its abnormality, if the print job in which the sheet transportation path P1 is used is received, the CPU 205 cannot execute the image formation based on the print job. Accordingly, the received print job is stored in the HDD 209. After then, if the print job in which the sheet transportation path P2 is used is received in the state that the second fixing unit 402 cannot be used due to its abnormality, the CPU 205 can execute the image formation based on the print job. Accordingly, the CPU 205 executes the second transportation process.

As just described, if the first fixing unit 401 cannot be used, the printing device 100 can execute neither the first transportation process nor the second transportation process. On the other hand, if the second fixing unit 402 cannot be used, the printing device 100 cannot execute the first transportation process but can execute the second transportation process. Consequently, if the received print job is the job in which the sheet transportation path P1 is used, the CPU 205 stores the relevant print job in the HDD 209 without executing it. On the other hand, if the received print job is the job in which the sheet transportation path P2 is used, the CPU 205 executes the second transportation process. By doing so, even if the second fixing unit 402 cannot be used, the second transportation process can be executed, whereby it is possible to improve use efficiency of the printing device 100 without deteriorating quality of the printing process.

Second Embodiment

Subsequently, the second embodiment of the present invention will be described.

As illustrated in FIG. 11, in the print job according to the first embodiment, the sheet feeding unit information and the sheet attribute information are commonly used for the respective pages. However, in the second embodiment, the sheet feeding unit information and the sheet attribute information are used independently for the respective pages. Incidentally, in the first embodiment, the image formation condition is set for the print job, through the setting screens of the computer terminal 102 respectively illustrated in FIGS. 7 to 10. On the other hand, in the second embodiment, it is assumed that the image formation condition can be set independently for each of the pages included in the print job. Moreover, it should be noted that the second embodiment is a modification of the first embodiment. Accordingly, the description of the second embodiment is substantially the same as that of the first embodiment except for the following points.

Figure 14:
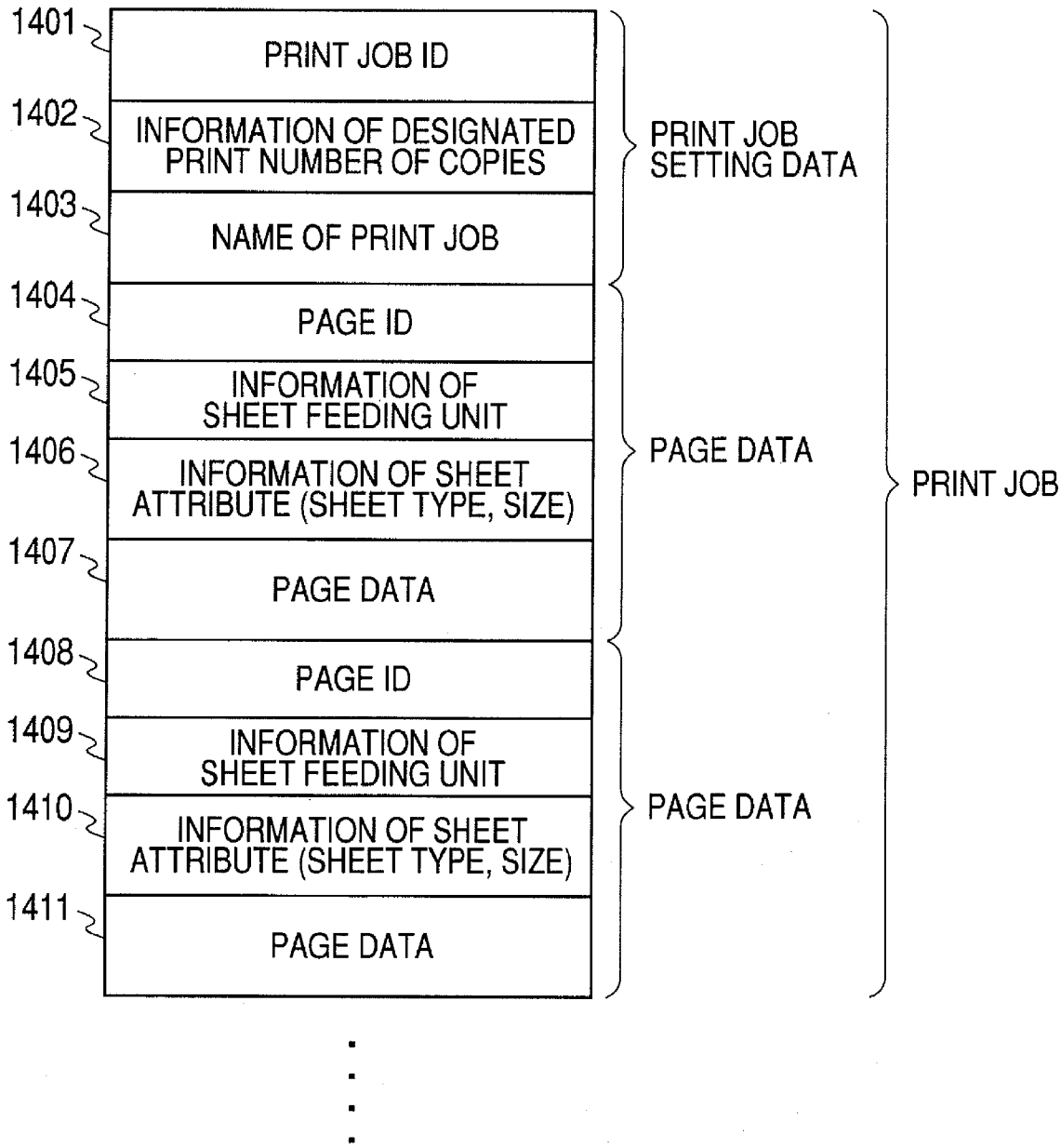
FIG. 14 is a diagram illustrating a data configuration of a print job to be transmitted from the computer terminal 102 to the printing device 100.

FIG. 14 is a diagram illustrating a data configuration of the print job to be transmitted from the computer terminal 102 to the printing device 100. Here, it should be noted that the print job illustrated in FIG. 14 includes, as document data, page data corresponding to plural pages.

In FIG. 14, a print job ID 1401 is a unique ID which is given to the print job so that, when the computer terminal 102 transmits the print job to the printing device 100, the transmitted print job can be identified on the side of the printing device 100. Further, information 1402 of designated print number of copies (hereinafter, called designated print number of copies information) identifies the print number of copies which was input in the print number of copies setting box 1104, and a name 1403 of the print job (hereinafter, called a print job name) to which the text data indicating a file name necessary in case of administration by the application is given as the print job name. Here, it is assumed that the print job ID 1401, the designated print number of copies information 1402 and the print job name 1403 are set as print job setting data.

In FIG. 14, a page ID 1404 is an ID which is unique to each page for discriminating page data of each of the plural pages included in the print job. Information 1405 of the sheet feeding unit (hereinafter, called sheet feeding unit information) identifies the sheet feeding unit which is selected in the sheet feeding unit selection box (that is, the box which is displayed when "designate based on feeding source" is selected in the sheet feeding method selection box 2301). Information 1406 of the sheet attribute (hereinafter, called sheet attribute information) includes sheet size information which specifies the output sheet size selected in the output sheet size selection box 2102. In addition, the sheet attribute information 1406 includes the sheet kind information which indicates the kind of sheet selected from the table 2302 illustrated in FIG. 10. Further, page data 1407 is the data for each page included in the document (document text) data created by the application which operates on the computer terminal 102. Incidentally, it should be noted that the page ID 1404, the sheet feeding unit information 1405, the sheet attribute information 1406 and the page 1407 are called the page data in the lump. The page data includes information which is necessary to execute the printing process for each page included in the document data.

Incidentally, it should be noted that, in FIG. 14, the data 1404, 1405, 1406 and 1407 are the page data of the first page included in the print job, and data 1408, 1409, 1410 and 1411 are the page data of the second page included in the print job. Further, it should be noted that, although the page data of the first page and the second page are illustrated in FIG. 14, the page data of the third and subsequent pages are omitted therefrom. The computer terminal 102 can of course create the print job of an arbitrary number of pages.

Subsequently, an operation to be executed by the printing device 100 which received the print job from the computer terminal 102 will be described with reference to a flow chart illustrated in FIG. 15.

Figure 15:
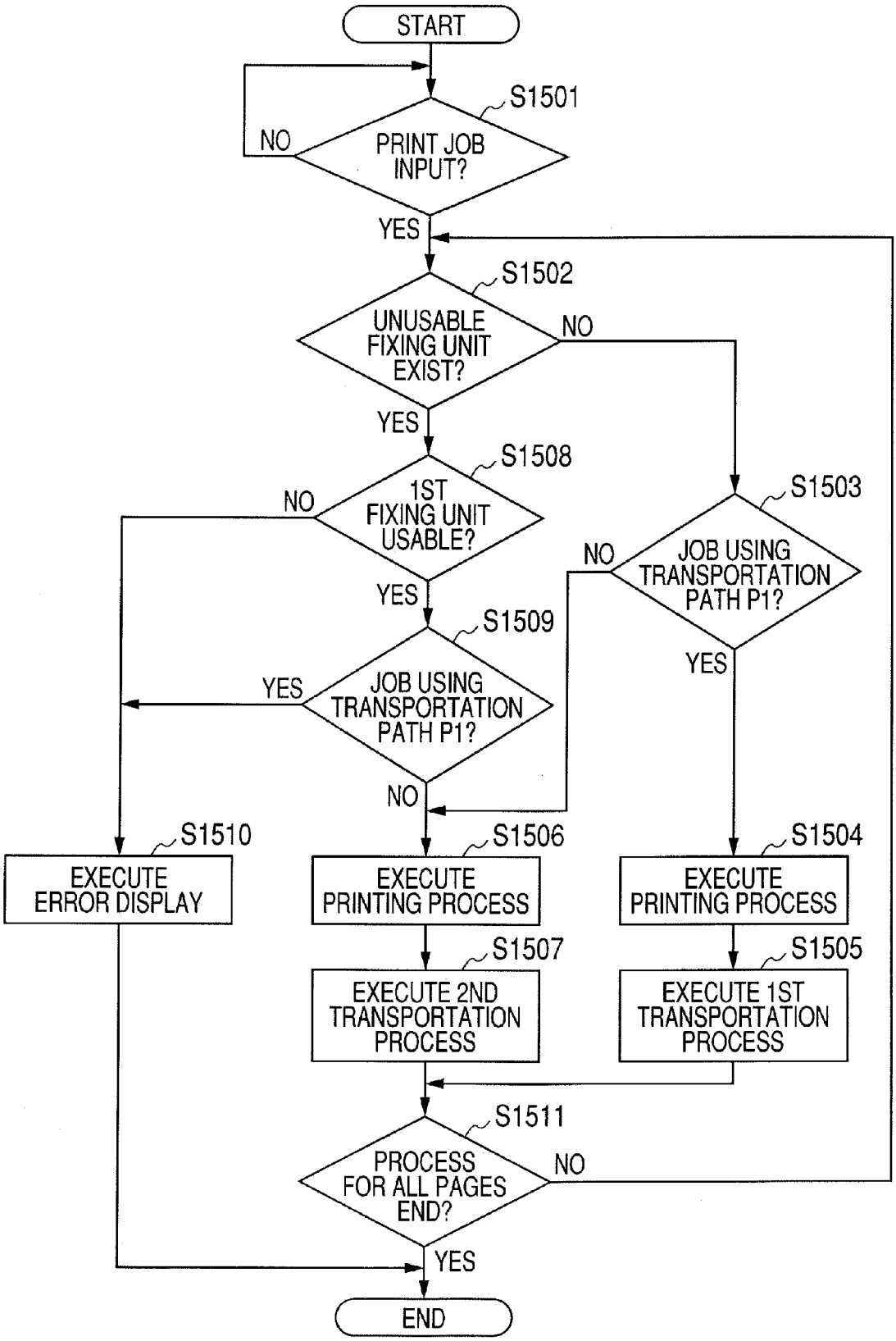
FIG. 15 is a flow chart illustrating an operation to be executed by the printing device 100.

In a step S1501 of FIG. 15, it is determined by the CPU 205 whether or not the print job is received from the computer terminal 102. If it is determined that the print job is received from the computer terminal 102, the flow advances to a step S1502.

In the step S1502, it is determined by the CPU 205 whether or not there is an unusable fixing unit (that is, a fixing unit which cannot be used). Here, if it is determined that there is an unusable fixing unit, the flow advances to a step S1508. On the other hand, if it is determined that there is no unusable fixing unit, the flow advances to a step S1503. Here, it should be noted that a case where the fixing unit cannot be used is the same as that already described in the first embodiment. Incidentally, the fixing unit indicates the first fixing unit 401 and the second fixing unit 402 which are illustrated in FIG. 4.

In the step S1503, it is determined by the CPU 205, based on the image formation condition information added to the print job received from the computer terminal 102, whether the first page of the received print job is the page which is to be transported on the sheet transportation path P1 or the page which is to be transported on the sheet transportation path P2. More specifically, it is determined by the CPU 205 whether or not the first page of the received print job is the page for which the sheet transportation path P1 is used, based on the sheet attribute information 1406 added to the page data of the first page of the print job and the information on the table illustrated in FIG. 13. For example, if the information indicating a plain sheet has been added as the sheet attribute information 1406 of the first page, it is determined by the CPU 205 that the print job is the job in which the sheet transportation path P2 is used. In any case, if it is determined by the CPU 205 that the first page of the print job received in the step S1501 is the page for which the sheet transportation path P1 is used, the flow advances to a step S1504. On the other hand, if it is determined by the CPU 205 that the first page of the received print job is the page for which the sheet transportation path P2 is used, the flow advances to a step S1506.

In the step S1504, the CPU 205 causes the printer unit 203 to execute the printing process based on the first page of the print job, and the flow advances to a step S1505.

In the step S1505, the CPU 205 causes the printer unit 203 to execute the first transportation process. Here, it should be noted that the first transportation process is the process to transport the sheet S on the sheet transportation path P1, and thus to execute both the fixing process by the first fixing unit 401 and the fixing process by the second fixing unit 402 to the sheet S. Incidentally, when the first transportation process is executed, the fixing control unit 2009 controls temperature based on the information on the table illustrated in FIG. 13. For example, for a page of the print job to which the information indicating a thick sheet has been added as the sheet attribute information, the fixing control unit 2009 sets the temperature in the fixing process by the first fixing unit 401 to 180° C., and also sets the temperature in the fixing process by the second fixing unit 402 to 180° C.

If in the step S1503 the CPU determined that the print job received in step S1501 is a print job for which the sheet transportation path P2 is to be used, the process flow moves to step S1506. In the step S1506, the CPU 205 causes the printer unit 203 to execute the printing process based on this page of the print job, and the flow advances to a step S1507.

In the step S1507, the CPU 205 causes the printer unit 203 to execute the second transportation process. Here, it should be noted that the second transportation process is the process to transport the sheet S on the sheet transportation path P2, and thus to execute only the fixing process by the first fixing unit 401 to the sheet S. Incidentally, when the second transportation process is executed, the fixing control unit 2009 controls temperature based on the information on the table illustrated in FIG. 13. For example, for a page of the print job to which the information indicating a "plain sheet" has been added as the sheet attribute information, the fixing control unit 2009 sets the temperature in the fixing process by the first fixing unit 401 to 185° C.

Subsequently, an operation to be executed in a case where it is determined by the CPU 205 in the step S1502 that the unusable fixing unit exists in the printing device 100 will be described hereinafter.

In the step S1508, it is determined by the CPU 205 whether or not the first fixing unit 401 can be used, based on the determination result in the step S1502. Then, if it is determined by the CPU 205 that the first fixing unit 401 can be used, the flow advances to a step S1509. On the other hand, if it is determined by the CPU 205 that the first fixing unit 401 cannot be used, the flow advances to a step S1510.

In the step S1509, as in the step S1503, it is determined by the CPU 205 whether or not the first page of the print job is the page for which the sheet transportation path P1 is used. Then, if it is determined by the CPU 205 that the first page of the print job is the page for which the sheet transportation path P2 is used, the flow advances to the step S1506. On the other hand, if it is determined by the CPU 205 that the first page of the print job is the page for which the sheet transportation path P1 is used, the flow advances to a step S1510.

In the step S1510, the CPU 205 executes an error display on the operation unit 204 so as to indicate that, since a printing process of the first page of the print job which was received from the computer terminal 102 in the step S1501 cannot be executed, it is necessary to prepare the first fixing unit for use. After the step S1510 is executed, the CPU 205 ends the process flow.

In a step S1511, it is determined by the CPU 205 whether or not the processes for all the pages included in the print job end. Then, if it is determined by the CPU 205 that not all pages of the job have yet been processed, the process in the step S1502 is executed again. On the other hand, if it is determined that the processes for all the pages have been completed, the process flow ends.

Incidentally, it is assumed that the CPU 205 executes the process flow illustrated in FIG. 15 every time the print job is received from the computer terminal 102. For example, in a case where the second fixing unit 402 cannot be used due to its abnormality, if the print job which includes the page for which the sheet transportation path P1 is used is received, the CPU 205 knows the first fixing unit cannot apply a satisfactory fixing process to the page. As soon as the first such unfixable page is reached in the processing ("YES" in step S1509) the image formation for all pages of the print job is stopped. Accordingly, the received print job with such an unfixable page is stored in the HDD 209. However, if another print job is then received in the state that the second fixing unit 402 cannot be used due to its abnormality, and this other print job only includes pages for which the sheet transportation path P2 is used, the CPU 205 can execute the image formation based on the print job. Accordingly, the CPU 205 can proceed with image formation for this other job by executing the second transportation process for each page.

As just described, if the first fixing unit 401 cannot be used, the printing device 100 cannot execute both the first transportation process and the second transportation process. On the other hand, if the second fixing unit 402 cannot be used, the printing device 100 cannot execute the first transportation process but can execute the second transportation process. Consequently, if the received print job is the job in which the sheet transportation path P1 is used for at least one sheet, the CPU 205 stores the relevant print job in the HDD 209 without executing it. On the other hand, if the received print job is the job in which the sheet transportation path P2 is used for every sheet, the CPU 205 executes the print job using the second transportation process for each sheet. By doing so, even if the second fixing unit 402 cannot be used, the second transportation process can be executed, whereby it is possible to improve use efficiency of the printing device 100 without deteriorating quality of the printing process.

Moreover, in the print job of the second embodiment, since the sheet feeding unit information and the sheet attribute information are added independently for each page, it is possible to appropriately execute the first transportation process or the second transportation process for each page on the basis of the sheet attribute information. Therefore, instead of suspending the image formation for the whole job when the first page requiring P1 is reached, it would be possible to continue with the print job so as to print those pages which do not require P1. This could be achieved by branching from step S1509 ("YES") to step S1511 instead of to step S1510. In this case, the pages requiring P1 would be stored in the HDD 209 until the second fixing unit became available again.

Incidentally, in FIG. 15 the process flow is carried out repeatedly for each page of the print job in turn. Accordingly, in the step S1509 of FIG. 15, it is determined by the CPU 205 whether or not the certain specific page is the page for which the sheet transportation path P1 is used. However, the present invention is not limited to this. More specifically, it may be determined by the CPU 205 after step S1501 whether or not any one of the plural pages included in the print job is the page for which the sheet transportation path P1 is used. Namely, if it is determined that any one of the plural pages included in the print job is the page for which the sheet transportation path P1 is used, the CPU 205 advances the process to the step S1510. In this case, even if the first and subsequent pages included in the print job are the sheets (pages) to which the second transportation process can be executed, the print job is not executed at all. This is advantageous in the point that the print job including the document data of the plural pages is not interrupted in the middle of the printing process. In summary, when the printing device is in the state in which the first fixing unit is usable but the second fixing unit is not usable (predetermined state) and, in this state, a mixed-sheet print job is received, some of whose pages require the sheet transportation path P1, it is possible to: (a) not print the pages requiring P1 but print the remaining pages; or (b) not print any of the pages of the job; or (c) print all pages of the job but operating the first fixing unit under a first operating condition for the pages requiring P2 and under a second operating condition for the pages requiring P1. Option (c) is described later in conjunction with the third embodiment.

Third Embodiment

Subsequently, the third embodiment of the present invention will be described.

The printing device 100 in the first embodiment does not execute the print job in which the sheet transportation path P1 is used, in the state that the second fixing unit 402 cannot be used. The reason why the printing device 100 in the first embodiment does not execute the print job in which the sheet transportation path P1 is used is that both the first fixing unit 401 and the second fixing unit 402 are necessary to execute the fixing process to the sheet which is used in the printing process. Moreover, the reason why the two fixing units are necessary is that fixability of a toner image to the sheet deteriorates if a sufficient amount of heat cannot be applied to the sheet. On the other hand, in the third embodiment, the printing device 100 executes the print job without deteriorating fixability by lowering sheet transportation speed for the print job in which the sheet transportation path P1 is used. Besides, it should be noted that the third embodiment is a modification of the first embodiment. Accordingly, the description of the third embodiment is substantially the same as that of the first embodiment except for the points particularly described as below.

Subsequently, an operation to be executed by the printing device 100 which received the print job from the computer terminal 102 will be described with reference to a flow chart illustrated in FIG. 16.

Figure 16:
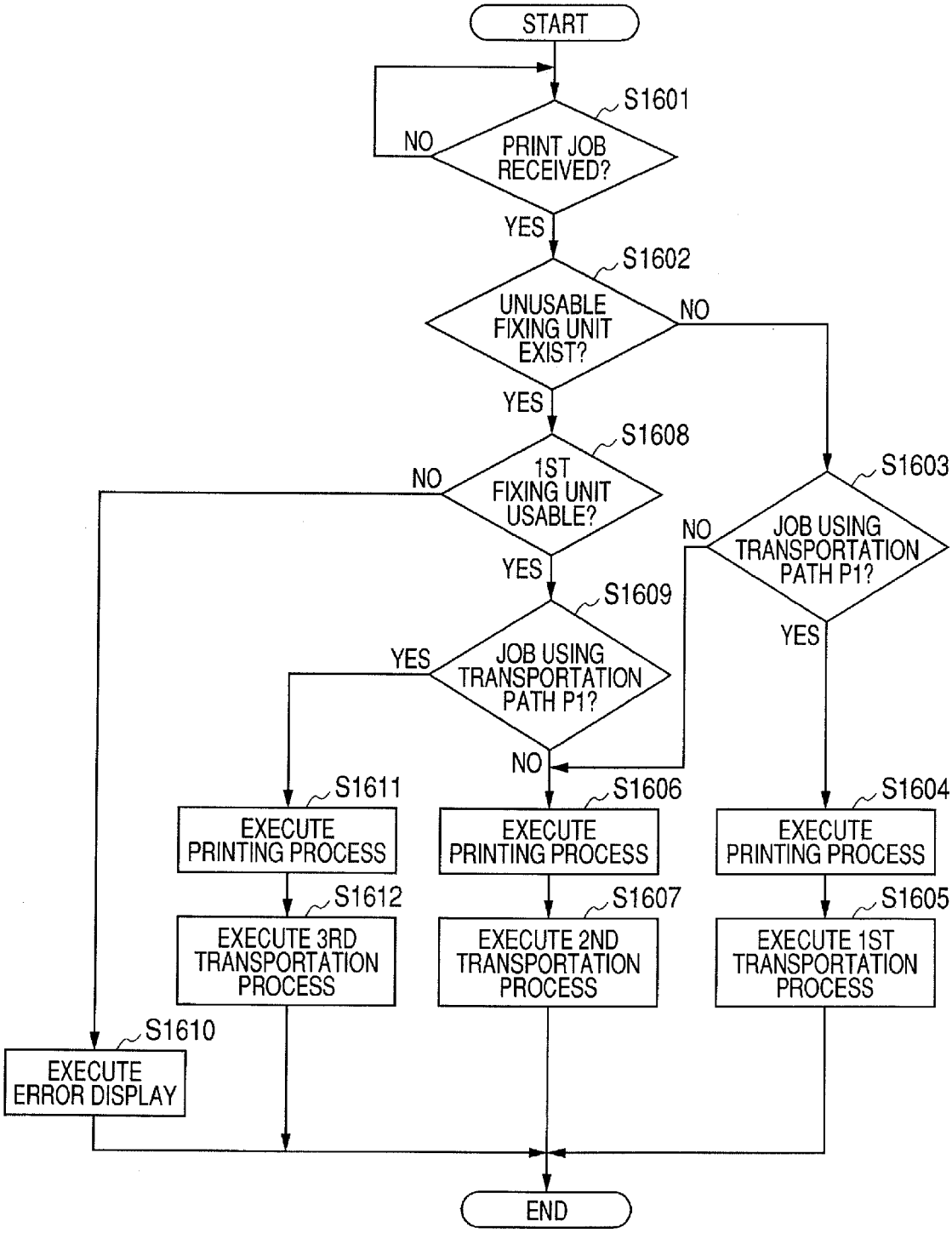
FIG. 16 is a flow chart illustrating an operation to be executed by the printing device 100.

Here, it should be noted that FIG. 16 is a modification of FIG. 12 in the first embodiment, and processes in steps S1601 to S1610 in FIG. 16 are the same as those in the steps S1201 to S1210 in FIG. 12, whereby the description of these processes will be omitted.

Step S1611 is reached when the first fixing unit 401 is usable but the second fixing unit 402 is unusable and, according to the table of FIG. 13, the sheet transportation path P1 (requiring the unusable second fixing unit) is to be used for the print job. In step S1611, the CPU 205 causes the printer unit 203 to execute the printing process based on the print job, and the flow advances to a step S1612.

In the step S1612, the CPU 205 causes the printer unit 203 to execute a third transportation process. Here, it should be noted that the third transportation process is the process to transport the sheet S on the sheet transportation path P2, even though the sheet transportation path P1 was specified by the table of FIG. 13, and thus to execute only the fixing process by the first fixing unit 401 to the sheet S. Incidentally, when the third transportation process is executed, the fixing control unit 2009 controls temperature based on the information on the table illustrated in FIG. 13. For example, with respect to the print job to which the information indicating a "thick sheet has been added as the sheet attribute information, the fixing control unit 2009 sets the temperature in the fixing process by the first fixing unit 401 to 180° C. Incidentally, although the third transportation process is to transport the sheet S on the sheet transportation path P2 as well as the first transportation process, sheet transportation speed in the third transportation process is different from that in the first transportation process. For example, the CPU 205 transmits a command to the sheet transportation control unit 2004 so as to set the transportation speed of the sheet S in the third transportation process to approximately half as much as the transportation speed of the sheet S in the first transportation process. Incidentally, in the present embodiment, although the transportation speed of the sheet in the third transportation process is set to be lower (slower) than the transportation speed in the first transportation process, it is of course possible to set the transportation speed to any of two or more permissible values to cope with the various different kinds of sheet requiring P1. For example, the speed value for "ABC coated 3" could be slower than the speed value for "thick sheet".

In the present embodiment, the process in the step S1612 is executed after the process in the step S1611 is executed. However, if the print job includes the document data of plural pages, the processes in the steps S1611 and S1612 are executed respectively to different pages in parallel.

According to the third transportation process as just described, even if the second fixing unit 402 cannot be used, the CPU 205 can improve use efficiency of the printing device 100 by executing the print job without deteriorating fixability of the toner image to the sheet. More specifically, the printing device 100 in the third embodiment can improve its use efficiency by executing the print job, in which the sheet transportation path P1 should be originally used, with use of the sheet transportation path P2 at a lower sheet transportation speed.

Figure 17:
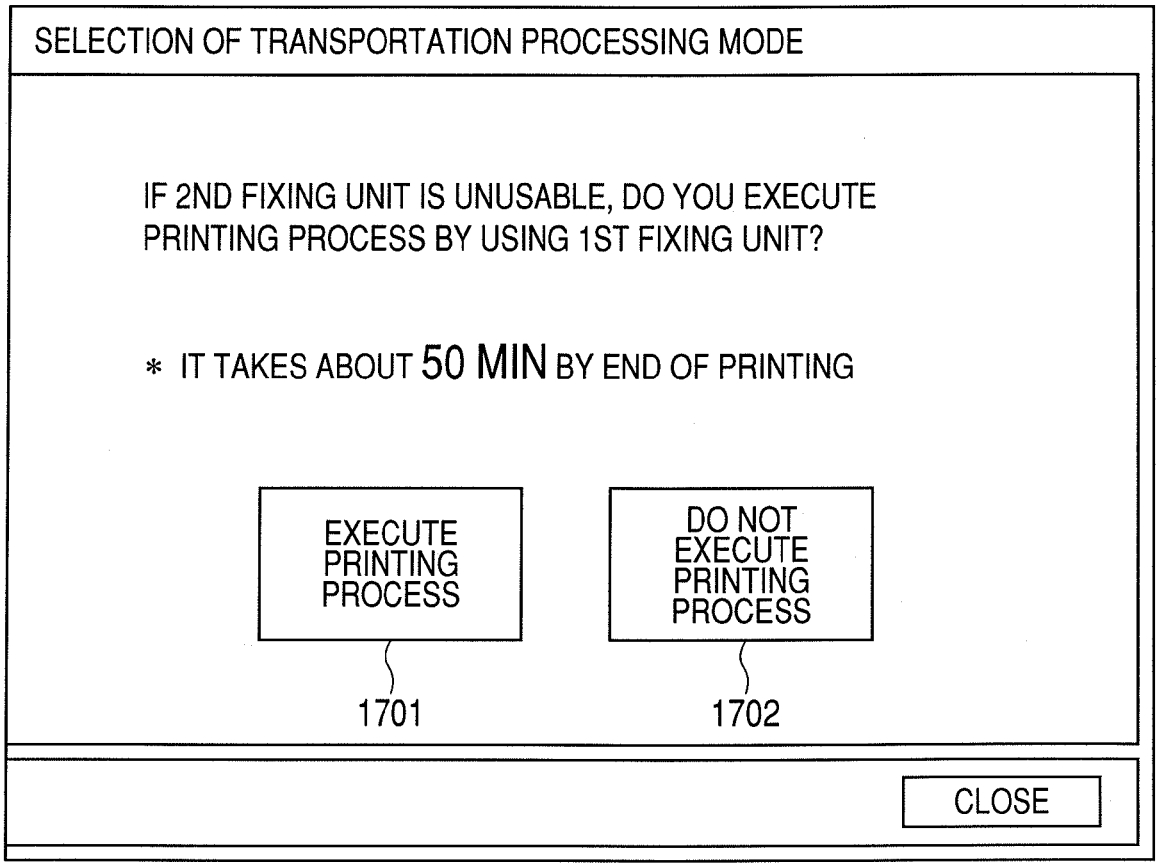
FIG. 17 is a diagram illustrating a screen to be displayed on an operation unit 204.

Incidentally, in a variant of the present embodiment, the operator of the printing device 100 may select, for a print job for which the sheet transportation path P1 should normally be used, whether to execute the print job, in which the sheet transportation path P1 using the sheet transportation path P1, as in the first embodiment, or to execute the print job using the sheet transportation path P2 at a lower sheet transportation speed. In this case, the CPU 205 causes the operation unit 204 to display a screen as illustrated in FIG. 17, and detects which of keys 1701 and 1702 the operator of the printing device 100 selects. Then, if the operator selects the key 1701, the CPU 205 executes the process flow illustrated in FIG. 16. On the other hand, if the operator selects the key 1702, the CPU 205 executes the process flow illustrated in FIG. 12. The screen of FIG. 17 may be displayed at the time of input of a print job in which the sheet transportation path P1 should be used. Alternatively, the screen of FIG. 17 may be displayed in response to an operator's instruction before any such print job is input, for example during a set-up operation.

Incidentally, when the screen of FIG. 17 is displayed at the time of input of a print job, the screen also displays how long it will take to execute the relevant process flow. More specifically, the screen of FIG. 17 notifies that, in case of executing the printing process for a print job of 1,500 pages when the sheet transportation speed is lowered from 60 sheets/minute to 30 sheets/minute, it takes about 50 minutes. Accordingly, the operator (user) of the printing device 100 can select either to proceed with the print job by pressing the key 1701 or not to proceed with the print job by pressing the key 1702, in consideration of a time necessary by the end of the printing process. In the latter case, the process flow moves to step S1610 in which (as in the step S1210 in FIG. 12) the print job is stored in the HDD 209 until the second fixing unit 402 becomes usable again. Incidentally, the CPU 205 may select itself whether or not to execute a print job, for which the sheet transportation path P1 was originally specified, by using the sheet transportation path P2 at a lower sheet transportation speed, based on a maximum completion time previously input by the operator as the maximum time permitted to complete the printing process for any given print job. Such a maximum completion time may be input by the operator when a screen like that of FIG. 17 is displayed in advance of input of any print job. For example, in a case where the operator inputs to select 40 minutes as the time necessary by the end of the printing process, if the actual completion time for the job is 50 minutes as illustrated in FIG. 17, the CPU 205 may cause the process flow to move to step S1610 automatically, without displaying the screen of FIG. 17 or requiring any intervention from the operator. On the other hand, if the actual completion time is less than or equal to the specified maximum completion time, the CPU 205 may cause the process flow to carry on automatically through steps S1611 and S1612. As mentioned above in connection with the second embodiment, for a print job including some sheets originally specifying P1 and other sheets specifying P2, it is possible to apply option (c) described in connection with the second embodiment. In particular, it is possible to print all pages of the job but operate the first fixing unit with a normal sheet transportation speed (first operating condition) for the pages requiring P2 and with a lower sheet transportation speed (second operating condition) for the pages requiring P1.

Fourth Embodiment

Subsequently, the fourth embodiment of the present invention will be described.

The printing device 100 in the first embodiment does not execute the print job in which the sheet transportation path P1 is used, in the state that the second fixing unit 402 cannot be used. The reason why the printing device 100 in the first embodiment does not execute the print job in which the sheet transportation path P1 is used is that both the first fixing unit 401 and the second fixing unit 402 are necessary to execute the fixing process to the sheet which is used in the printing process. Moreover, the reason why the two fixing units are necessary is that fixability of a toner image to the sheet deteriorates if a sufficient amount of heat cannot be applied to the sheet. On the other hand, in the fourth embodiment, the printing device 100 executes the print job without deteriorating fixability by changing a kind of sheet for the print job in which the sheet transportation path P1 is used. Besides, it should be noted that the fourth embodiment is a modification of the first embodiment. Accordingly, the description of the fourth embodiment is substantially the same as that of the first embodiment except for the points particularly described as below.

Subsequently, an operation to be executed by the printing device 100 which received the print job from the computer terminal 102 will be described with reference to a flow chart illustrated in FIG. 18.

Figure 18:
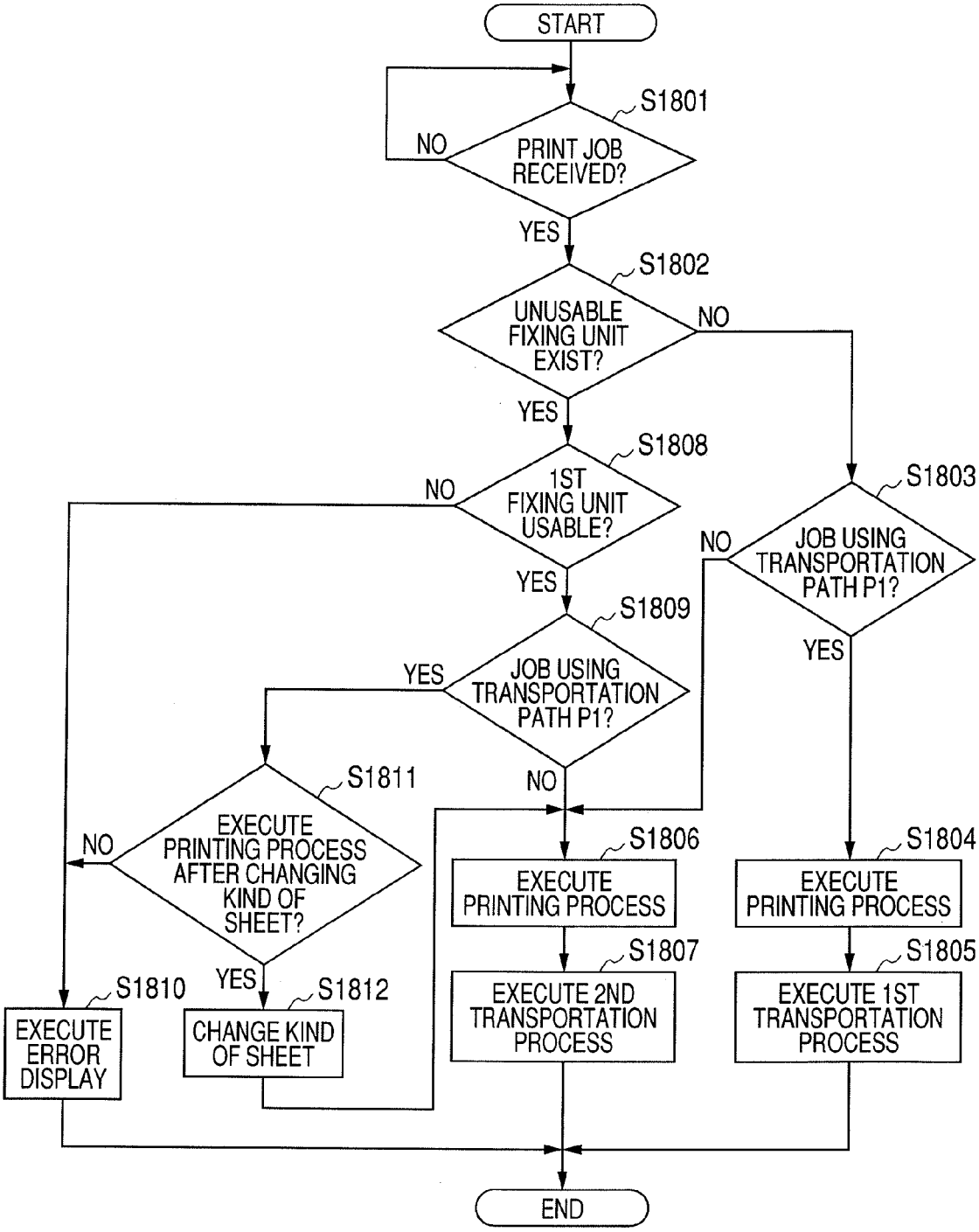
FIG. 18 is a flow chart illustrating an operation to be executed by the printing device 100.

Here, it should be noted that FIG. 18 is a modification of FIG. 12 in the first embodiment, and processes in steps S1801 to S1810 in FIG. 18 are the same as those in the steps S1201 to S1210 in FIG. 12, whereby the description of these processes will be omitted.

Figure 19:
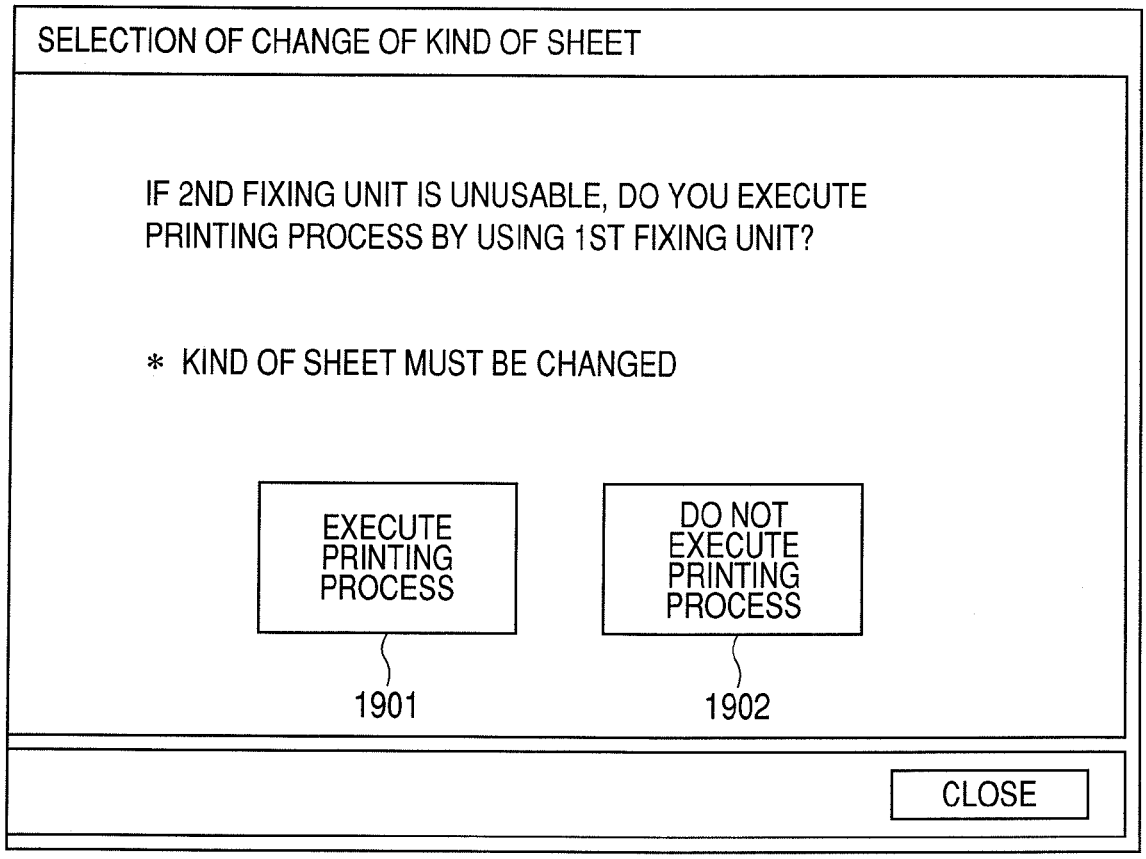
FIG. 19 is a diagram illustrating a screen to be displayed on the operation unit 204.

In a step S1811, the CPU 205 causes the operation unit 204 to display a screen illustrated in FIG. 19, on which the operator selects whether or not to execute the printing process after changing the kind of sheet. In this case, the CPU 205 detects which of keys 1901 and 1902 the operator of the printing device 100 selects. Then, if the operator selects the key 1901, the flow advances to a step S1812. On the other hand, if the operator selects the key 1902, the flow advances to a step S1810.

Figure 20:
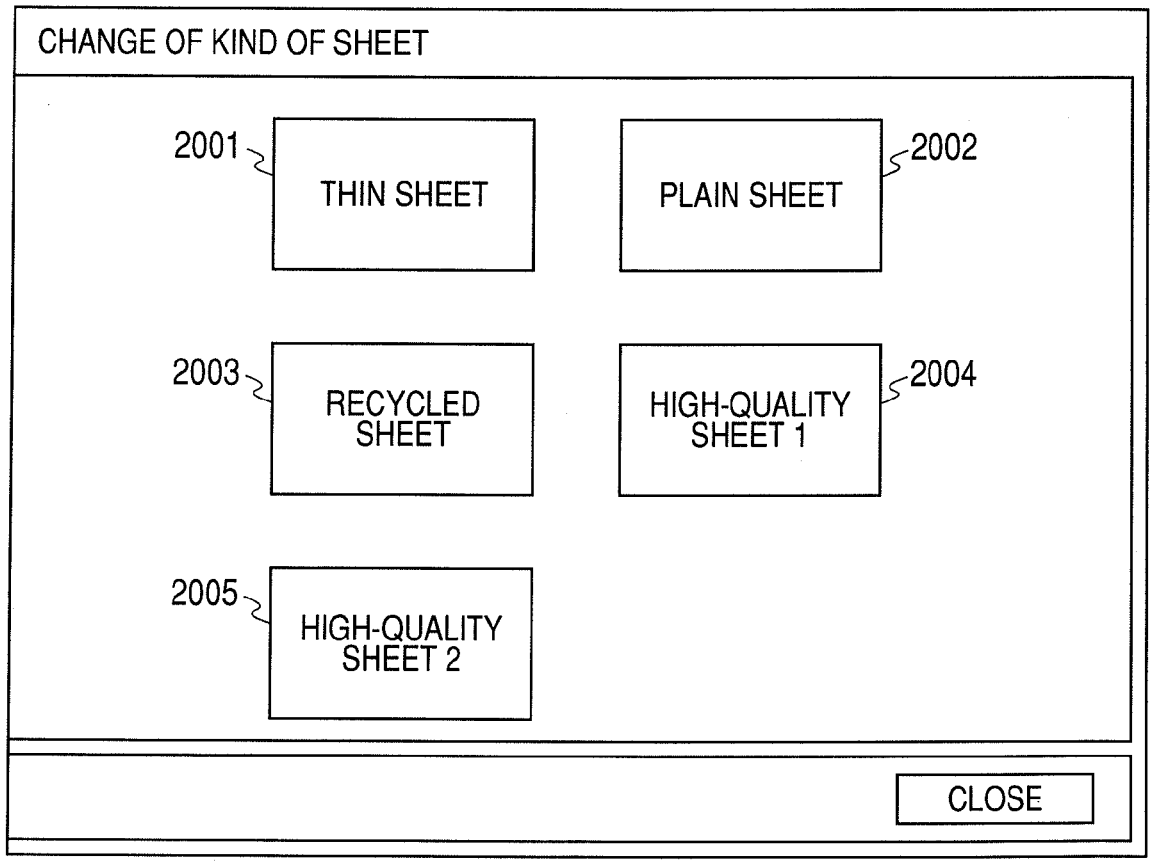
FIG. 20 is a diagram illustrating a screen to be displayed on the operation unit 204.

In the step S1812, the CPU 205 changes the kind of sheet in response to an instruction from the operator of the printing device 100. Namely, the CPU 205 causes the operator of the operation unit 204 to select, by using the table illustrated in FIG. 13, the sheet to which the printing process can be executed by using the sheet transportation path P2. More specifically, the CPU 205 causes the operation unit 204 to display a screen illustrated in FIG. 20 for designating the sheet (thin sheet 2001, plain sheet 2002, recycled sheet 2003, high-quality sheet 1 2004, and high-quality sheet 2 2005) for which the sheet transportation path P2 is used. Then, the CPU 205 changes the sheet attribute information so as to use the sheet, which was selected by the operator through the screen illustrated in FIG. 20, in the printing process. Then, in case of executing the process in the step S1806 in succession to the process in the step S1812, the CPU 205 executes the printing process after selecting the kind of sheet based on the sheet attribute information changed in the step S1812.

By changing the kind of sheet as described above, the CPU 205 can execute the print job without deteriorating quality of the printing process even if the second fixing unit 402 cannot be used, whereby it is possible to improve use efficiency of the printing device 100. More specifically, the printing device 100 in the fourth embodiment can improve its use efficiency by executing the print job, in which the sheet transportation path P1 should be originally used, by using the sheet transportation path P2 with a different (changed) kind of sheet to be used in the printing process.

Other Embodiments

In the above-described embodiments, the print job (that is, the image formation job) is received from the computer terminal 102. However, the present invention is not limited to this. For example, the print job including the input image data may be input from the scanner unit 201. In this case, it is assumed that the image formation condition information included in the print job is input through the operation unit 204.

The present invention can be implemented in hardware or software or in a combination of the two. Thus one embodiment of the present invention also provides a program which can realize the functions of the above-described embodiments when executed by a processor (CPU 205) or computer of the printing device. Such a program can be provided by itself or carried in or by a carrier medium. The carrier medium may be a storage medium, which stores program codes of software to realize the functions of the above-described embodiments, and which is supplied to a system or an apparatus. In this case, a computer provided in the system or the apparatus reads and executes the program codes stored in the storage medium, to realize the functions of the above-described embodiments. Here, since the program codes themselves read from the storage medium realize the functions of the above-described embodiments in this case, whereby the storage medium which stores these program codes constitutes the present invention. The carrier medium may alternatively be a transmission medium such as a signal. Such a signal may be transmitted through a network to enable the program to be downloaded from a server to the printing device.

As described above, an embodiment of the present invention can provide an image formation device comprising: an input unit configured to input an image formation job which at least includes condition information indicating image data and an image formation condition in case of executing image formation based on the image data; an image formation unit configured to form a toner image on a sheet based on the image formation job input by the input unit; a first fixing unit configured to execute a fixing process to fix the formed toner image on the sheet; a second fixing unit, provided on a downstream side of the first fixing unit along a sheet transportation direction, configured to execute the fixing process to the sheet on which the toner image has been fixed by the first fixing unit; a first transportation unit configured to execute a first transportation process to discharge the sheet, on which the fixing process was executed by the first fixing unit, to a sheet discharge unit through the second fixing unit; a second transportation unit configured to execute a second transportation process to discharge the sheet, on which the fixing process was executed by the first fixing unit, to the sheet discharge unit without passing the sheet through the second fixing unit; and a control unit configured to control to execute the first transportation process or the second transportation process based on the condition information, wherein, in a case where the first fixing unit cannot be used, the control unit controls not to execute the first transportation process and the second transportation process, and in a case where the first fixing unit can be used and the second fixing unit cannot be used, the control unit controls not to execute the first transportation process but to execute the second transportation process.

In one embodiment the image formation job includes the image data corresponding to plural pages, the condition information having been added to each of the plural pages, and the control unit controls to execute either the first transportation process or the second transportation process with respect to each of the plural pages.

In one embodiment, in a case where the second fixing unit cannot be used, the control unit controls not to execute the first transportation process to the page to which the condition information corresponding to the first transportation process has been added, but to execute the second transportation process to the page to which the condition information corresponding to the second transportation process has been added.

In one embodiment, in a case where the second fixing unit cannot be used, the control unit controls not to execute the first transportation process and the second transportation process to all the pages in the image formation job including the page to which the condition information corresponding to the second transportation process has been added.

In one embodiment, in a case where the second fixing unit cannot be used, the control unit controls to execute the second transportation process to the page to which the condition information corresponding to the first transportation process has been added and the page to which the condition information corresponding to the second transportation process has been added.

In one embodiment, in the case where the second fixing unit cannot be used, the control unit controls to execute, at first transportation speed, the second transportation process to the page to which the condition information corresponding to the second transportation process has been added, and to execute, at second transportation speed lower than the first transportation speed, the second transportation process to the page to which the condition information corresponding to the first transportation process has been added.

In one embodiment, the device further comprises: a selection unit configured to cause, in a case where the second fixing unit cannot be used, a user of the image formation device to select whether to execute the first transportation process or to execute the second transportation process with respect to the page to which the condition information corresponding to the first transportation process has been added; and a change unit configured to change, in a case where it is selected by the selection unit to execute the second transportation process with respect to the page to which the condition information corresponding to the first transportation process has been added, the condition information corresponding to the first transportation process to the condition information corresponding to the second transportation process.

In one embodiment the condition information is information which indicates an attribute of the sheet to be used when the image formation unit forms the toner image.

In one embodiment the device further comprises a detection unit configured to detect whether or not abnormality occurs in the second fixing unit, wherein, in a case where the detection unit detects the occurrence of the abnormality, the control unit controls not to execute the first transportation process but to execute the second transportation process.

In one embodiment the device further comprises a setting unit configured to execute setting as to whether or not to use the second fixing unit, wherein, in a case where the setting unit executes the setting not to use the second fixing unit, the control unit controls not to execute the first transportation process but to execute the second transportation process.

In one embodiment the device further comprises a determination unit configured to determine whether or not sheet transportation abnormality occurs in a transportation path for transporting the sheet from the first fixing unit to the second fixing unit or in a transportation path for transporting the sheet from the second fixing unit to the sheet discharge unit, wherein, in a case where the determination unit determines that the sheet transportation abnormality occurs, the control unit controls not to execute the first transportation process but to execute the second transportation process.

Another embodiment of the present invention can provide an image formation method, in an image formation device which comprises a first fixing unit for executing a fixing process to fix a toner image, formed on a sheet, to the sheet, and a second fixing unit, provided on a downstream side of the first fixing unit along a sheet transportation direction, for executing the fixing process to the sheet on which the toner image has been fixed by the first fixing unit, the image formation method comprising: inputting an image formation job which at least includes condition information indicating image data and an image formation condition in case of executing image formation based on the image data; forming the toner image on the sheet based on the input image formation job; executing a first transportation process to discharge the sheet, on which the fixing process was executed by the first fixing unit, to a sheet discharge unit through the second fixing unit; executing a second transportation process to discharge the sheet, on which the fixing process was executed by the first fixing unit, to the sheet discharge unit without passing the sheet through the second fixing unit; and controlling to execute the first transportation process or the second transportation process based on the condition information, wherein, in a case where the first fixing unit cannot be used, it is controlled not to execute the first transportation process and the second transportation process, and in a case where the first fixing unit can be used and the second fixing unit cannot be used, it is controlled not to execute the first transportation process but to execute the second transportation process.

As many apparently widely different embodiments of the present invention can be made without departing from the spirit and scope thereof, it is to be understood that the present invention is not limited to the specific embodiments thereof except as defined in the appended claims.

This application claims the benefit of Japanese Patent Application No. 2007-021420, filed Jan. 31, 2007, which is hereby incorporated by reference herein in its entirety.

What is claimed is:

1. An image formation device comprising:

a fixing device, having a first fixing unit and a second fixing unit, each operable to apply a fixing process to a sheet, the first and second fixing units being so arranged that, if the second fixing unit is not usable, the fixing device can apply the fixing process to the sheet using the first fixing unit; and a control unit operable to detect when the image formation device is in a predetermined state in which the first fixing unit is usable but the second fixing unit is not usable, and further operable to cause the fixing device to apply the fixing process to at least one sheet using the first fixing unit while the image formation device is in the predetermined state, wherein the first fixing unit is operable selectively to carry out a fixing process under a first operating condition or to carry out a fixing process under a second operating condition different from the first operating condition, and the control unit is further operable, when the image formation device is in the predetermined state, to determine whether or not the first fixing unit is suitable for applying a fixing process to a sheet under the first operating condition and, if not, to cause the fixing device to apply a fixing process to the sheet using the first fixing unit under the second operating condition.

2. The image formation device according to claim 1, wherein the control unit is operable, when the image formation device is in the predetermined state, to determine whether or not the first fixing unit is suitable for applying the fixing process to the sheet and, if so, to cause the fixing device to apply the fixing process to the sheet using the first fixing unit and, if not, to cause operation of the fixing device for the sheet to be suspended.

3. The image formation device according to claim 2, further comprising:

an image formation unit which applies an image formation process to the sheet prior to supply of the sheet to the fixing device;

wherein the control unit is operable, when it is detected that the image formation device is in the predetermined state, to determine, before the image formation process for the sheet is carried out by the image formation unit, whether or not the first fixing unit is suitable for applying a fixing process to the sheet and, if not, to inhibit the image formation unit from carrying out the image forming process for the sheet.

4. The image formation device according to claim 2, wherein the control unit is operable, if it is determined that the first fixing unit is not suitable for applying a fixing process to the sheet when the image formation device is in the predetermined state, to cause an input to be obtained from an operator of the device for selecting a different sheet for which the first fixing unit is suitable for applying the fixing process.

5. The image formation device according to claim 4, further comprising:

an input unit operable to receive an image formation job including sheet attribute information relating to one or more attributes of one or more sheets of the job concerned;

wherein the control unit is operable to employ the sheet attribute information to determine whether or not the first fixing unit is suitable for applying a fixing process to one or more sheets of the job when the image formation device is in the predetermined state and, if not, to change the sheet attribute information for the sheet or job in dependence upon one or more attributes of the sheet selected by the operator.

6. The image formation device according to claim 1, wherein the first and second fixing units are arranged in series along a sheet transportation path provided in the fixing device so that a sheet supplied to the fixing device can first be subjected to a fixing process by one of the fixing units and then be subjected to a fixing process by the other of the fixing units.

7. The image formation device according to claim 6, wherein the second fixing unit is provided on a downstream side of the first fixing unit in a sheet transportation direction so as to apply the fixing process to a sheet on which a toner image has been fixed by the first fixing unit;

the image formation device further comprising:

a first transportation unit operable to execute a first transportation process to discharge the sheet, on which the fixing process was executed by the first fixing unit, to a sheet discharge unit through the second fixing unit;

a second transportation unit operable to execute a second transportation process to discharge the sheet, on which the fixing process was executed by the first fixing unit, to the sheet discharge unit without passing the sheet through the second fixing unit.

8. The image formation device according to claim 7, further comprising a detection unit operable to detect whether or not an abnormality occurs in the second fixing unit, wherein the control unit is operable, when the detection unit detects the occurrence of the abnormality, to inhibit execution of the first transportation process and to cause execution of the second transportation process.

9. The image formation device according to claim 7, further comprising a determination unit operable to determine whether or not a sheet transportation abnormality occurs in a transportation path for transporting the sheet from the first fixing unit to the second fixing unit or in a transportation path for transporting the sheet from the second fixing unit to the sheet discharge unit, wherein the control unit is operable, when the determination unit determines that the sheet transportation abnormality occurs, to inhibit execution of the first transportation process and to cause execution of the second transportation process.

10. The image formation device according to claim 1, wherein the first and second operating conditions are different values of a sheet transportation speed at which the sheet is transported through the first fixing unit.

11. The image formation device according to claim 10, wherein:

the first and second fixing units are arranged in series along a sheet transportation path provided in the fixing device so that a sheet supplied to the fixing device can first be subjected to a fixing process by one of the fixing units and then be subjected to a fixing process by the other of the fixing units; and the control unit is operable to set the sheet transportation speed to a first value when a sheet is being subjected to a fixing process by both fixing units and to a second value, lower than the first value, when a sheet is being subjected to a fixing process by the first fixing unit but not the second fixing unit.

12. The image formation device according to claim 1, wherein the control unit is operable to inhibit the fixing device from using the first fixing unit under the second operating condition in dependence upon an input from an operator of the device.

13. The image formation device according to claim 12, wherein the control unit is operable to cause such an operator input to be obtained in the event that the image formation device is in the predetermined state when an image formation job is received.

14. The image formation device according to claim 13, wherein the control unit is also operable to cause the image formation device to provide information to the operator about a time required to complete the job if the first fixing unit is used under the second operating condition.

15. The image formation device according to claim 12, wherein the control unit is operable to cause such an operator input to be obtained before the device enters the predetermined state.

16. An image formation device according to claim 15, wherein the operator input further comprises information specifying a maximum completion time for an image formation job, and the control unit is operable, when the image formation job is received after the image formation device has entered the predetermined state, to compare an actual completion time of the job if the fixing device applies the fixing process using the first fixing unit under the second operating condition with the specified maximum completion time, and to cause the fixing device to apply the fixing process using the first fixing unit under the second operating condition if the actual completion time is less than or equal to the specified maximum completion time, and otherwise to suspend operation of the fixing device.

17. The image formation device according to claim 1, further comprising:

an input unit operable to receive an image formation job including sheet attribute information relating to one or more attributes of one or more sheets of the job, wherein the control unit is operable to employ the sheet attribute information to determine whether or not the first fixing unit is suitable for applying a fixing process to one or more sheets of the job when the image formation device is in the predetermined state.

18. The image formation device according to claim 17, wherein the input unit is operable to receive a mixed-sheet image formation job including one or more sheets of a first kind and one or more sheets of a second kind, the first fixing unit being suitable for applying a fixing process to the or each sheet of the first kind, but not being suitable for applying a fixing process to the or each sheet of the second kind, when the image formation device is in the predetermined state.

19. The image formation device according to claim 18, wherein the mixed-sheet image formation job includes the sheet attribute information for each successive sheet of the job.

20. The image formation device according to claim 18, wherein the control unit is operable, when the image formation device is in the predetermined state and the mixed-sheet image formation job has been received, to inhibit the image formation unit from carrying out the image forming process for any sheets of the job.

21. An image formation method, for use in an image formation device comprising a fixing device having a first fixing unit and a second fixing unit, each operable to apply a fixing process to a sheet, the first and second fixing units being so arranged that, if the second fixing unit is not usable, the fixing device can apply the fixing process to the sheet using the first fixing unit, wherein the first fixing unit is operable selectively to carry out a fixing process under a first operating condition or to carry out a fixing process under a second operating condition different from the first operating condition, the method comprising:

detecting when the image formation device is in a predetermined state in which the first fixing unit is usable but the second fixing unit is not usable;

causing the fixing device to apply the fixing process to at least one sheet using the first fixing unit while the image formation device is in the predetermined state; and when the image formation device is in the predetermined state, determining whether or not the first fixing unit is suitable for applying a fixing process to a sheet under the first operating condition and, if not, causing the fixing device to apply a fixing process to the sheet using the first fixing unit under the second operating condition.

22. A non-transitory machine-readable recording medium storing a program, the program being adapted to be executed by a computer or processor in an image formation device comprising a fixing device having a first fixing unit and a second fixing unit, each operable to apply a fixing process to a sheet, and the first and second fixing units being so arranged that, if the second fixing unit is not usable, the fixing device can apply the fixing process to the sheet using the first fixing unit, wherein the first fixing unit is operable selectively to carry out a fixing process under a first operating condition or to carry out a fixing process under a second operating condition different from the first operating condition, the program when executed causing the image formation device to:

detect when the image formation device is in a predetermined state in which the first fixing unit is usable but the second fixing unit is not usable;

cause the fixing device to apply the fixing process to at least one sheet using the first fixing unit while the image formation device is in the predetermined state; and when the image formation device is in the predetermined state, determine whether or not the first fixing unit is suitable for applying a fixing process to a sheet under the first operating condition and, if not, to cause the fixing device to apply a fixing process to the sheet using the first fixing unit under the second operating condition.

* * * * *